US009717334B2

(12) United States Patent
Goetz et al.

(10) Patent No.: US 9,717,334 B2
(45) **Date of Patent: *Aug. 1, 2017**

(54) DRIVE DEVICE FOR A MOVABLE FURNITURE PART

(71) Applicant: Julius Blum GmbH, Hoechst (AT)

(72) Inventors: Christof Goetz, Lustenau (AT); Florian Fischer, Hoechst (AT)

(73) Assignee: JULIUS BLUM GMBH, Hoechst (AT)

( * ) Notice: Subject to any disclaimer, the term of this patent is extended or adjusted under 35 U.S.C. 154(b) by 0 days.

This patent is subject to a terminal disclaimer.

(21) Appl. No.: 14/865,055

(22) Filed: Sep. 25, 2015

(65) Prior Publication Data

US 2016/0007750 A1 Jan. 14, 2016

Related U.S. Application Data

(63) Continuation of application No. PCT/AT2014/000056, filed on Mar. 26, 2014.

(30) Foreign Application Priority Data

Apr. 12, 2013 (AT) ..... 292/2013

(51) Int. Cl.
*A47B 95/00* (2006.01)
*A47B 88/04* (2006.01)
(Continued)

(52) U.S. Cl.
CPC ..... *A47B 88/0477* (2013.01); *A47B 88/463* (2017.01); *A47B 88/47* (2017.01); *A47B 88/49* (2017.01); *A47B 88/57* (2017.01)

(58) Field of Classification Search
CPC . A47B 88/0477; A47B 88/0481; A47B 88/08; A47B 88/16; A47B 88/0466;
(Continued)

(56) References Cited

U.S. PATENT DOCUMENTS 4,828,344 A 5/1989 Omata
5,040,833 A * 8/1991 Brunnert ..... A47B 88/0477 292/80
(Continued)

FOREIGN PATENT DOCUMENTS

CA 2 743 055 12/2012
CN 102413733 4/2012
(Continued)

OTHER PUBLICATIONS

International Search Report issued Jul. 14, 2014 in corresponding International Application No. PCT/AT2014/000056 (with English translation).
(Continued)

*Primary Examiner* — Hanh V Tran
(74) *Attorney, Agent, or Firm* — Wenderoth, Lind & Ponack, L.L.P.

(57) ABSTRACT

A drive device for a moveable furniture part including an ejection element, an ejection force accumulator, and a locking device for the ejection element. The locking device includes a locking journal which is subjected to force of the ejection force accumulator and can be locked in a locked position in a latch region of a guide track. The guide track is shaped like a curved heart and has a tightening section in which the locking journal can be moved when the ejection force accumulator is tightened, and a latching movement section of the locking journal prior to reaching the locked position in the latch region. The locking journal impinged upon by the tightened ejection force accumulator can be slowed down and/or dampened in the latching movement section and can be placed in the latch region.

19 Claims, 44 Drawing Sheets

(51) Int. Cl.

| | |
|---|---|
| ***A47B 88/463*** | (2017.01) |
| ***A47B 88/47*** | (2017.01) |
| ***A47B 88/49*** | (2017.01) |
| ***A47B 88/57*** | (2017.01) |

(58) Field of Classification Search
CPC ..... A47B 88/0407; A47B 88/14; A47B 88/49; A47B 88/47; A47B 88/463; A47B 88/57; E05B 65/463
See application file for complete search history.

(56) References Cited

U.S. PATENT DOCUMENTS

| | | | | |
|---|---|---|---|---|
| 5,144,963 | A | 9/1992 | Dabringhaus et al. | |
| 5,306,081 | A * | 4/1994 | Fukumoto | B60K 37/04 312/222 |
| 7,347,515 | B1 * | 3/2008 | Lu | A47B 88/0477 312/319.1 |
| 7,374,261 | B1 * | 5/2008 | Wang | A47B 88/0477 312/319.1 |
| 8,534,781 | B2 | 9/2013 | Netzer et al. | |
| 8,807,671 | B2 * | 8/2014 | Brunnmayr | A47B 88/16 312/319.1 |
| 9,295,329 | B2 * | 3/2016 | Brunnmayr | A47B 88/0481 |
| 2007/0090735 | A1 * | 4/2007 | Hashemi | A47B 88/0477 312/334.46 |
| 2009/0072687 | A1 | 3/2009 | Fitz | |
| 2009/0284113 | A1 * | 11/2009 | MacElveen | A47B 88/0477 312/319.1 |
| 2010/0026152 | A1 * | 2/2010 | Huang | A47B 88/0477 312/319.1 |
| 2011/0129172 | A1 * | 6/2011 | Liang | A47B 88/0422 384/22 |
| 2011/0215690 | A1 * | 9/2011 | Juan | A47B 88/08 312/319.1 |
| 2012/0001441 | A1 * | 1/2012 | Juan | A47B 88/0477 292/164 |
| 2012/0038255 | A1 * | 2/2012 | Netzer | A47B 88/0477 312/319.1 |
| 2012/0319412 | A1 | 12/2012 | Liang et al. | |
| 2013/0334946 | A1 | 12/2013 | Netzer et al. | |
| 2014/0021841 | A1 | 1/2014 | Brunnmayr | |

FOREIGN PATENT DOCUMENTS

| | | |
|---|---|---|
| DE | 10 2011 002 212 | 10/2012 |
| EP | 0 483 590 | 5/1992 |
| EP | 0 766 939 | 4/1997 |
| JP | 2012-239738 | 12/2012 |
| WO | 2007/112463 | 10/2007 |
| WO | 2012/149587 | 11/2012 |

OTHER PUBLICATIONS

Austrian Search Report issued Dec. 4, 2013 in corresponding Austrian Patent Application No. A 292/2013 (with English translation).
Austrian Search Report issued Nov. 26, 2014 in corresponding Austrian Patent Application No. A 215/2014 (with English translation).

* cited by examiner

19

1
OS
4
36
37
54
41
28
16
7
6
E
45
53
3=15
14
9
56
55
53
7
54
43
29
S
E
45
79
A
U
R 36
37
OS
4
Ü
42
7
56
41
55
30
8
43
9
57

OS + V

OS

SS+V

SS+V

DRIVE DEVICE FOR A MOVABLE FURNITURE PART

BACKGROUND OF THE INVENTION

The invention concerns a drive device for a moveable furniture part comprising an ejection element, an ejection force storage member (accumulator) and a locking device for the ejection element. The locking device has a locking pin which is acted upon by the ejection force storage member (accumulator) and which is lockable in a locking position in a latching region of a guide path. The guide path has a cardioid-shaped configuration and the cardioid-shaped guide path has a stressing portion in which the locking pin is moveable upon stressing of the ejection force accumulator and a latching engagement movement region of the locking pin before the locking position in the latching region is reached. The invention further concerns an article of furniture comprising a furniture carcass, a furniture part moveable relative to the furniture carcass and such a drive device for the moveable furniture part.

Drive devices for ejecting a moveable furniture part from a closed position into an open position have already been known for many years in the furniture fitting industry. To guarantee that the ejection element or the moveable furniture part is securely held in a closed position, locking devices are provided in that arrangement. When opening of the moveable furniture part is wanted, the locking device can then be unlocked by actuation of a triggering mechanism. Unlocking can be effected for example by pressing against the moveable furniture part to push it into an over-pressing position. Triggering or unlocking is also possible by pulling. After such unlocking an ejection force accumulator can deliver its force and in so doing move the moveable furniture part in the opening direction by way of the ejection element.

After the ejection force accumulator has been relieved of its load upon opening of the moveable furniture part that ejection force must be restored to the ejection force accumulator again by stressing. That is generally effected when closing a moveable furniture part (but it can also be effected upon opening) by an operator who moves the moveable furniture by hand. When therefore a pressing force is applied to the moveable furniture part upon closure thereof, pressure is also applied against the force of the ejection force accumulator. As soon as the ejection force accumulator is fully stressed the locking pin of the locking device passes along the guide path into the latching region, in which case then the hand no longer holds the ejection force accumulator in its stressed position but the locking pin locks or holds the stressed ejection force accumulator in the locking position at the latching region.

A critical region in terms of stressing and locking is the region immediately prior to reaching the locking position in the latching region. More specifically if the latching pin, by virtue of the configuration of the guide path, passes into a region shortly before reaching the latching region, then the ejection force accumulator can act with a relatively high force on that locking pin, in which case that then comes into an abutment condition in the latching region with the production of a relatively large amount of noise and heavy wear.

DE 10 2011 002 212 R1 discloses a spring element which forms a latching recess but which only serves to also permit pulling unlocking.

WO 2007/112463 A2 entails the problem of noise generation, but for that purpose the entire moveable furniture part is braked before the ejection force accumulator is loaded.

SUMMARY OF THE INVENTION

Therefore, the object of the present invention is to provide a drive device which is improved over the state of the art. In particular, the invention seeks to provide that locking can be effected as quietly as possible. The invention further seeks to provide that locking can be effected with the lowest possible loading on the components involved.

Accordingly, it is provided that the locking pin which is acted upon by the stressed ejection force accumulator in braked and/or damped relationship is moveable in the latching engagement movement region and can be placed in the latching region. Accordingly, the full force of the ejection force accumulator no longer acts on the locking pin when the latching region is reached, but the movement of the locking pin is damped or braked before reaching the latching region.

With such a cardioid-shaped guide path, preferably the latching region is spaced in the opening direction of the moveable furniture part from a transitional region which is between the stressing region and the latching engagement movement region, preferably by between 0.2 mm and 3 mm. As the locking pin can be preferably completely uncoupled from a movement of the moveable furniture part as from reaching the transitional region and as therefore the locking pin is moveable into the latching region by the ejection force accumulator along the latching engagement movement region, it is precisely that spacing between the transitional region and the latching region in the previous cardioid-shaped guide paths that is the reason that relatively severe striking and locking noises occur by virtue of the high force which acts on the locking pin from the ejection force accumulator. The greater the force of the ejection force accumulator, the louder and more disturbing can the locking noises be. That is now prevented by the braking or damping action in respect of the locking pin.

In principle, a plurality of different ways in which the locking pin can be placed in the latching region in braked or damped relationship are conceivable.

A first variant provides that there is provided a damping device which is operative between the ejection force accumulator and the locking pin and which damps the kinetic energy transmitted from the ejection force accumulator into the locking pin before the locking position is reached. Thus, it is not the full energy that is transmitted to the locking pin as from attainment of the transitional region. In other words, the kinetic energy acting on the locking pin is reduced by the damping device. It is particularly preferable for that purpose that the kinetic energy acting on the locking pin is reduced by the damping device only in the latching engagement movement region of the locking pin. That damping device also does not have to damp the movement of the locking pin in the entire latching engagement movement region, but can also damp it only in a part of that region. A particularly preferred embodiment of such a damping device provides that the damping device is in the form of a travel transmission mechanism. Thus, it is not the entire energy that is immediately transmitted to the locking pin from the ejection force accumulator. That can be effected for example by an arrangement whereby the locking pin can be placed in the latching region in cam-controlled relationship by the travel transmission mechanism, wherein the travel transmission mechanism has a control cam by which the kinetic energy acting from the ejection force accumulator on the locking pin is preferably steadily increased along the latching engagement movement region in dependence on the control cam. A further variant for this slow delivery of the energy from the ejection force storage means to the locking pin provides that a damper, for example in the form of a linear damper, is arranged for example in the region of the ejection force accumulator or at its head. Thus, the first part of the stress relief travel of the ejection force accumulator is from full stressing to almost full stressing which is achieved in the closed position.

A second variant for placing the locking pin in the latching region in braked and/or damped relationship provides that the transfer of kinetic energy to the locking pin is not delayed or controlled, but rather the movement of the locking pin itself—on which the full force of the ejection force accumulator is already acting—is damped or braked. For that purpose an alternative configuration provides that the damping device has a moveable damping element, preferably a rotational damper, wherein the damping element includes a gear which is mounted in damped rotary relationship. At least one tooth of the gear can be contacted by the locking pin in the latching engagement movement region and is moveable in damped relationship in the direction of the latching region. Thus, in practice, the tooth of the gear in the latching engagement movement region forms a kind of brake so that the locking pin cannot move unimpededly into the latching region. As the locking pin is preferably arranged on a pivotable locking lever, the locking pin damping action can also be produced by the provision of a rotational damper or a friction brake in the region of the axis of rotation of the locking lever.

In principle, preferably a base plate and a slider form the ejection element, to give a structurally simple configuration, wherein the slider is moveable relative to the base plate and is lockable by way of the locking device to the base plate. In that case, the ejection force accumulator which is preferably in the form of a tension spring is fixed on the one hand to the base plate and on the other hand to the slider. To permit the movement of the locking pin in the guide path, preferably the locking pin is mounted rotatably to the slider by way of a locking lever and engages into the guide path in the base plate. In that case, as stated, the movement of the locking lever can also be damped by way of a damping device.

In principle, the ejection force accumulator can be loaded by opening and/or closing the moveable furniture part. It is also possible that the entire drive device can be unlocked or triggered by over-pressing the moveable furniture part into an over-pressing position which is behind the closed position in a closing direction and/or by pulling on the moveable furniture part into an open position in front of the closed position.

The essential components of the drive device can be arranged on the furniture carcass, and the moveable furniture part can be ejected by way of an entrainment portion mounted to the moveable furniture part or the drawer rail. In a preferred embodiment of the present invention, however, the base plate of the drive device can be arranged on the moveable article of furniture, and an entrainment portion which can be brought into engagement with the ejection element is arranged on the furniture carcass. Thus, the moveable furniture part virtually pushes itself away against the furniture carcass by the drive device.

BRIEF DESCRIPTION OF THE DRAWINGS

Further details and advantages of the present invention will be described more fully hereinafter by the specific description with reference to the embodiments by way of example illustrated in the drawings in which.

DETAILED DESCRIPTION OF THE INVENTION

Figure 1:
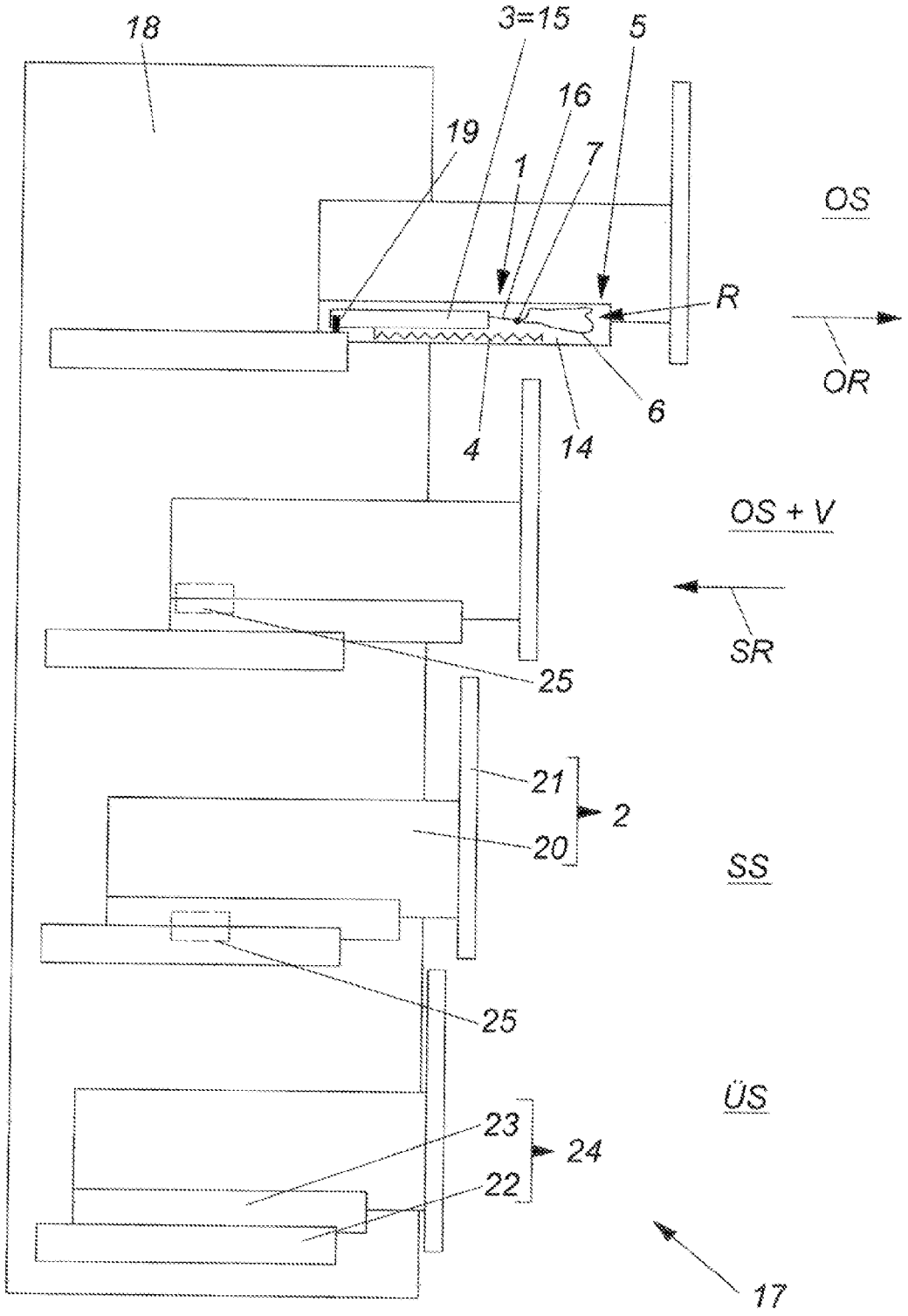
FIG. 1 shows an article of furniture with moveable furniture parts in various positions.

FIG. 1 shows an article of furniture 17 with a plurality of moveable furniture parts 2 in the form of drawers, mounted moveably to the furniture carcass 18. In this case, the individual moveable furniture parts 2 are respectively fixed to the furniture carcass 18 by an extension guide 24, the extension guide 24 including at least a carcass rail 22 and a drawer rail 23. There may possibly also be a central rail. The moveable furniture part 2 itself has at least one drawer container 20 and a front panel 21. The moveable furniture part 2 which is shown right at the top is in an open position OS and it can be diagrammatically seen that the drive device 1 is mounted to the drawer container 20 or the drawer rail 23. As essential components, the drive device 1 has a base plate 14 and an ejection element 3 moveable relative to the base plate 14. That ejection element 3 is in the form of a displaceable slider and is acted upon by the ejection force accumulator 4. The ejection element 3 is in engagement by way of an entrainment portion 19 with the carcass rail 22 and with the furniture carcass 18, respectively. Upon ejection, the drive device 1 bears against the entrainment portion 19 by the ejection element 3 and the ejection force accumulator 4 which in this case is in the form of a compression spring and moves the moveable furniture part 2 in the opening direction OR. That ejection element 3 is lockable to the base plate 14 by a locking device 5. For that purpose, the locking device 5 has a locking lever 16 mounted pivotably to the slider 15, the locking pin 7 disposed at the front end of the locking lever 16 and the guide path 6, in the base plate 14, together with the latching region R. When the moveable furniture part 2 is moved from the position shown by the uppermost drawer into the position therebeneath, then in that movement in the closing direction SR the slider 15 is moved towards the right relative to the base plate 14, with the ejection force accumulator 4 being stressed. As soon as the locking pin 7 passes into the latching region R of the guide path 6, the locking position V of the locking device 5 is reached. That can already be the case when the moveable furniture part 2 is still open, in particular when the moveable furniture part 2 is moved from the second illustrated position into the third illustrated position by a retraction device 25 (only diagrammatically indicated here) into the closed position SS. The lowermost illustration in FIG. 1 shows the triggering position or over-pressing position ÜS in which a pressure is applied to the moveable furniture part 2 in the closing direction SR thereby to unlock the locking device 5. It is, however, also possible to provide for unlocking by pulling.

Figure 2:
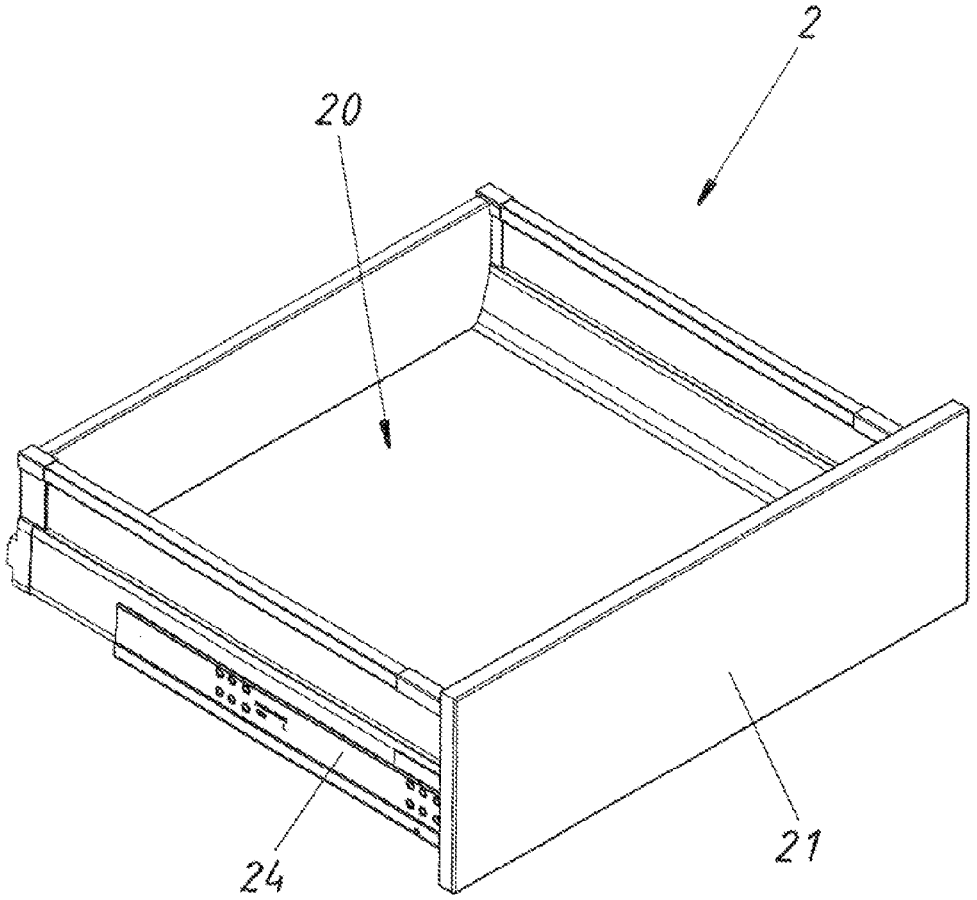
FIG. 2 is a 3D view of a moveable furniture part.

FIG. 2 shows a 3D view of the moveable furniture part 2, in which respect it can be seen that the moveable furniture part 2 comprises a drawer container 20 and the front panel 21. It can further be seen that the moveable furniture part 2 is connected to an extension guide 24.

Figure 3:
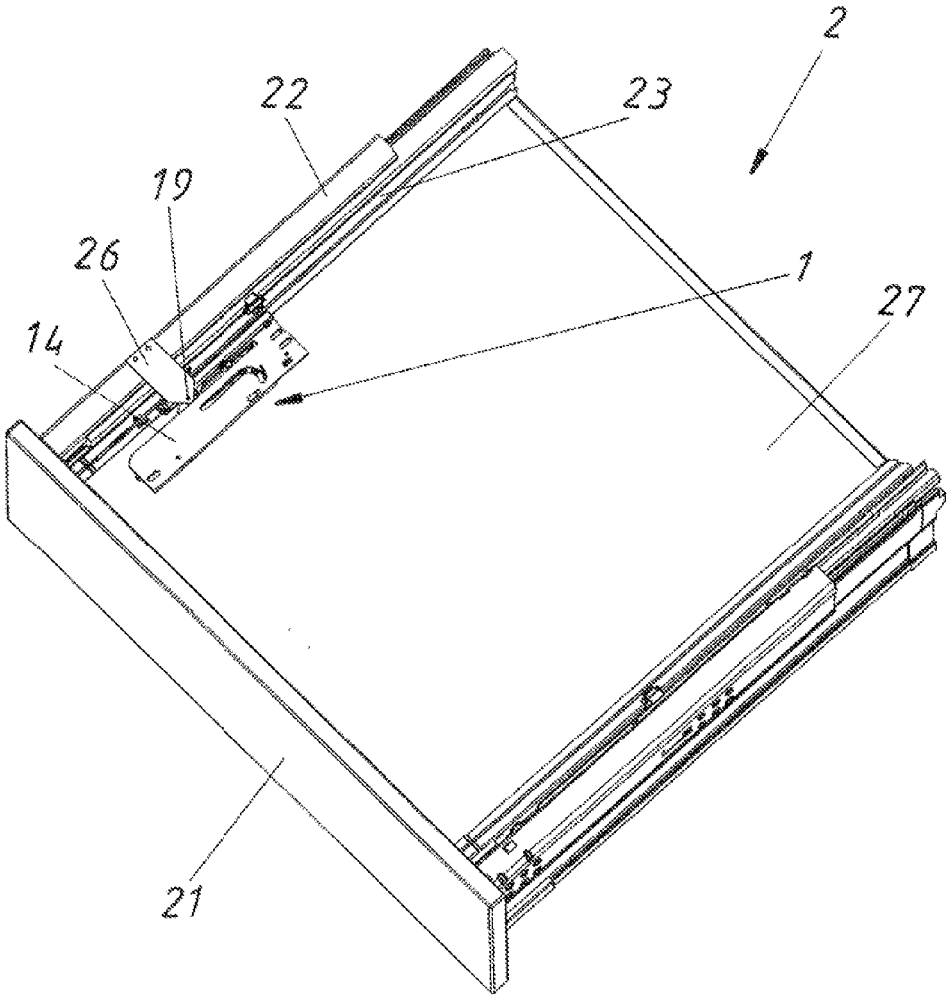
FIG. 3 shows the moveable furniture part from below with a drive device.

FIG. 3 shows the moveable furniture part 2 from below, with the drive device 1 together with the base plate 14 being mounted on the drawer bottom 27. Fixed to the carcass rail 22 is the entrainment plate 26 to which the entrainment portion 19 is mounted.

Figure 4:
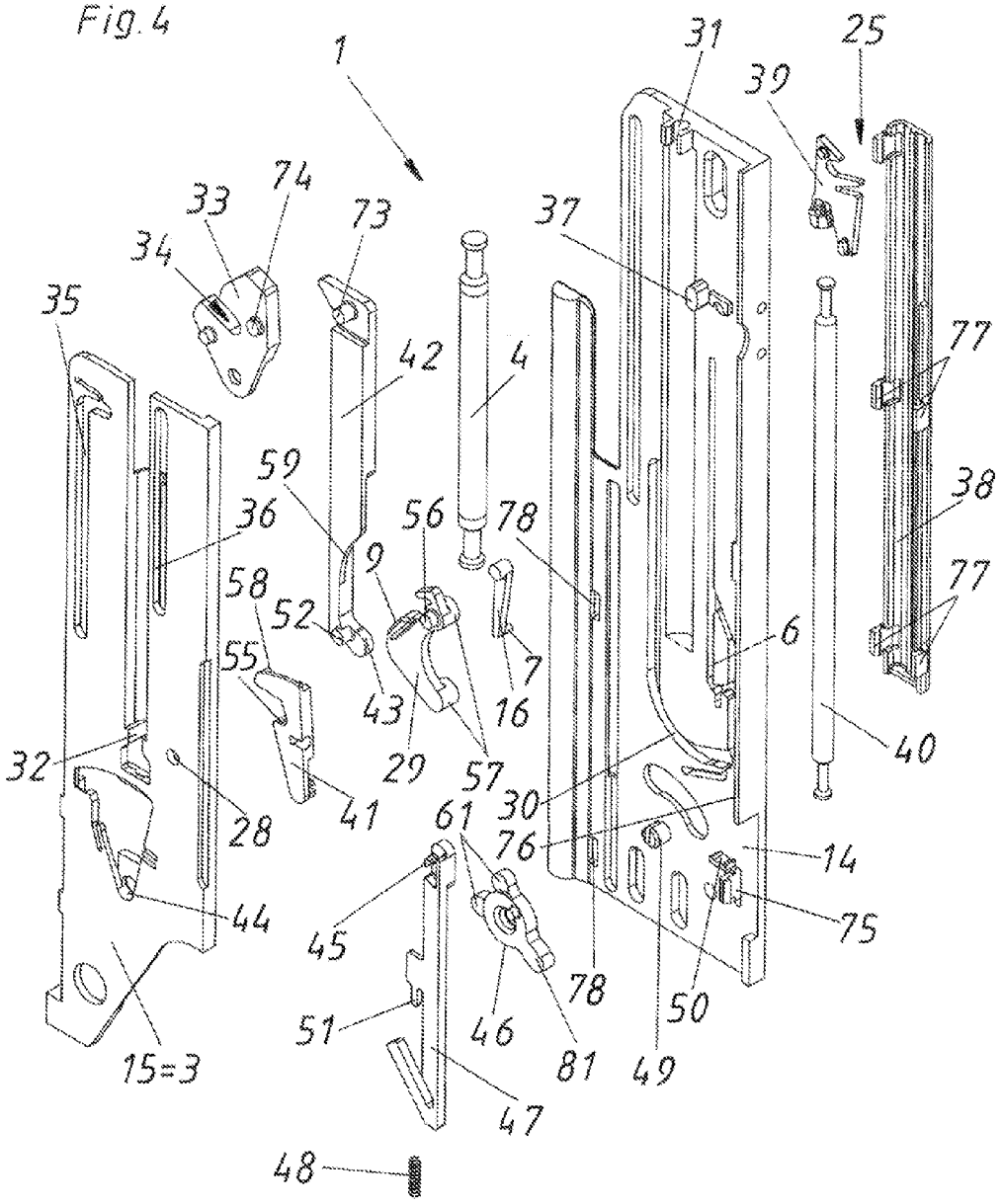
FIG. 4 is an exploded view of the drive device.

FIG. 4 shows an exploded view of the drive device 1, wherein the two main components are the base plate 14 and the slider 15 forming the ejection element 3. The linear movement of those two components 14 and 15 relative to each other is limited at least by the slider path limiter 37 mounted to the base plate 14 and the slider path 36 in the slider 15. A further important component is the ejection force accumulator 4 which is held at the spring base 31 on the base plate 14 and the spring base 32 on the slider 15. That ejection force accumulator 4 is in the form of a tension spring. The locking lever 16 with locking pin 7 and the cardioid-shaped guide path 6 are provided as the locking device 5. The locking lever 16 is mounted rotatably or pivotably at the rotary bearing 28 in the slider 15. In the mounted condition, the locking pin 7 engages into the guide path 6. There is further provided a transmission element 42 which is limitedly moveably mounted by the guide limiting member 52 to a path (not shown) provided at the underside of the slider 15. The coupling element 33 is pivotably mounted to that transmission element 42 at the pivot bearing 73. That coupling element 33 has the catch region 34 for the entrainment portion 19 (not shown). The pivotal movement of the coupling element 33 is controlled by way of the guide element 74 as the guide element 74 is guided in the coupling element guide path 35 in the slider 15. There is also a connecting element 41 mounted rotatably in the rotary bearing 44. A stressing abutment 55 is provided on that connecting element 41. Provided as a further component is the control element 29 which is moveable or displaceable by way of the guide elements 57 in the control element guide path 30 in the base plate 14. Also mounted to the control element 29 is the stressing element 56 which, upon stressing of the ejection force accumulator 4, bears against the stressing abutment 55 of the connecting element 41. The control element 29 also has the control cam 9, against which the abutment 43 on the transmission element 42 bears depending on the respective position. Those two components 43 and 9 together form a kind of travel transmission mechanism and thereby the damping device 8 for moving the locking pin 7 into the latching region R in damped relationship (this will be described in greater detail in the following Figures). In addition, the first pulling triggering element 46 is mounted rotatably to the base plate 14 by way of the rotary bearing 19. That first pulling triggering element 46 has the two limiting elements 61, between which the abutment 43 of the transmission element 42 is positioned in the closed position SS. There is also a second pulling triggering element 47 on which is provided the locking abutment 45 which also forms the latching region R. That locking abutment 45 thus forms a part of the guide path 6 and is moveable relative to the base plate 14. The displacement of that second pulling triggering element 47 is limited by the guide abutment 75 and the side surface 76 of the base plate 14. In addition, that second pulling triggering element 46 is pressured by way of the compression spring 48, wherein that compression spring 48 is fixed or held on the one hand at the spring base 50 and on the other hand at the spring base 51 on the second pulling triggering element 47. Lastly, the drive device 1 also has a retraction device 25 which as essential components has the retraction force accumulator 40, the retraction coupling element 39 and the cover element 38, wherein the cover element 38 is held by way of the holding clips 77 to the openings 78 in the base plate 14. The retraction force accumulator 40 is in the form of a tension spring.

Figure 5:
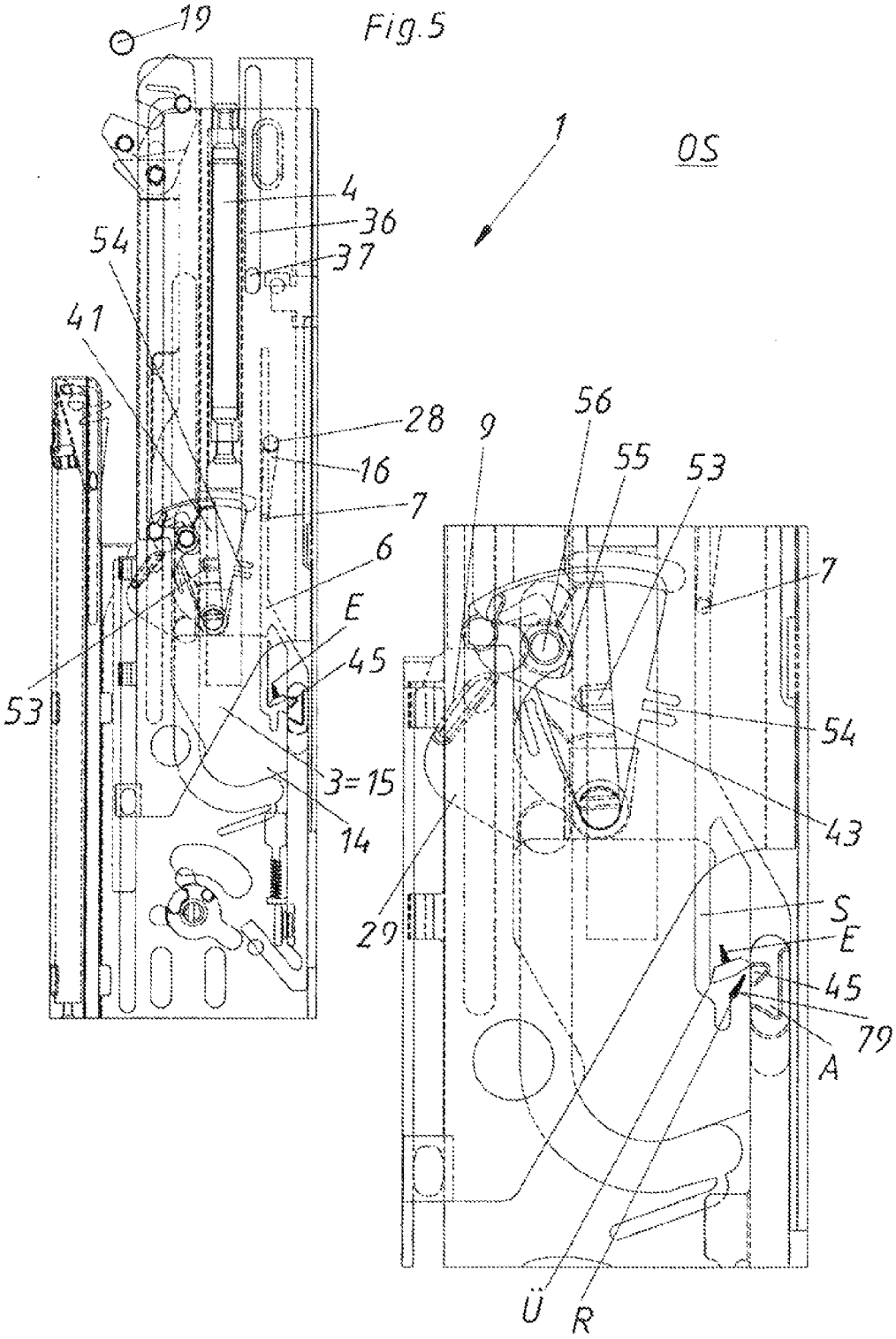
FIG. 5 through 18 show the drive device in various positions.

Referring to FIG. 5, the entire moveable furniture part 2 is in an open position OS, with the moveable furniture part 2 still being in the free-running condition. In other words, there is still no contact with the diagrammatically illustrated entrainment portion 19. The ejection force accumulator 4 is still relieved of stress, but pulls on the slider 15 until the end of the slider path 36 bears against the slider path limiting member 37. The locking pin 7 is guided in a stressing portion (stressing region) S of the guide path 6. The stressing element 56 of the control element 29 still does not bear against the stressing abutment 55 of the connecting element 41, but in contrast the abutment 43 of the transmission element 42 already bears against the control element 29 and there at the beginning of the control cam 9. By virtue of the compression spring (not shown) operative between the spring base 53 and the spring base 54, the connecting element 41 is pivoted towards the left about the rotary bearing 44. It can further be seen in the detailed view at bottom right that the guide path 6 has the latching engagement movement region E after the stressing region S and the transitional region Ü. The latching region R formed by the locking abutment 45 mounted to the second pulling triggering element 47 is disposed at the end of that latching engagement movement region E. That latching region R is followed by the ejection portion A, wherein the locking pin 7 passes into that ejection portion A by way of the diversion surface 79. It is only upon unlocking by over-pressing that the locking pin 7 meets that diversion surface 79. In contrast upon unlocking by pulling the locking abutment 45 is pulled away downwardly so that the path for the locking pin 7 into the ejection portion A is also free and the ejection force storage means 4 can be relieved of stress. FIGS. 6 through 18 which are described hereinafter do not always show all reference numbers. Naturally, however, the reference numbers always correspondingly apply for each of FIGS. 5 through 18.

Figure 6:
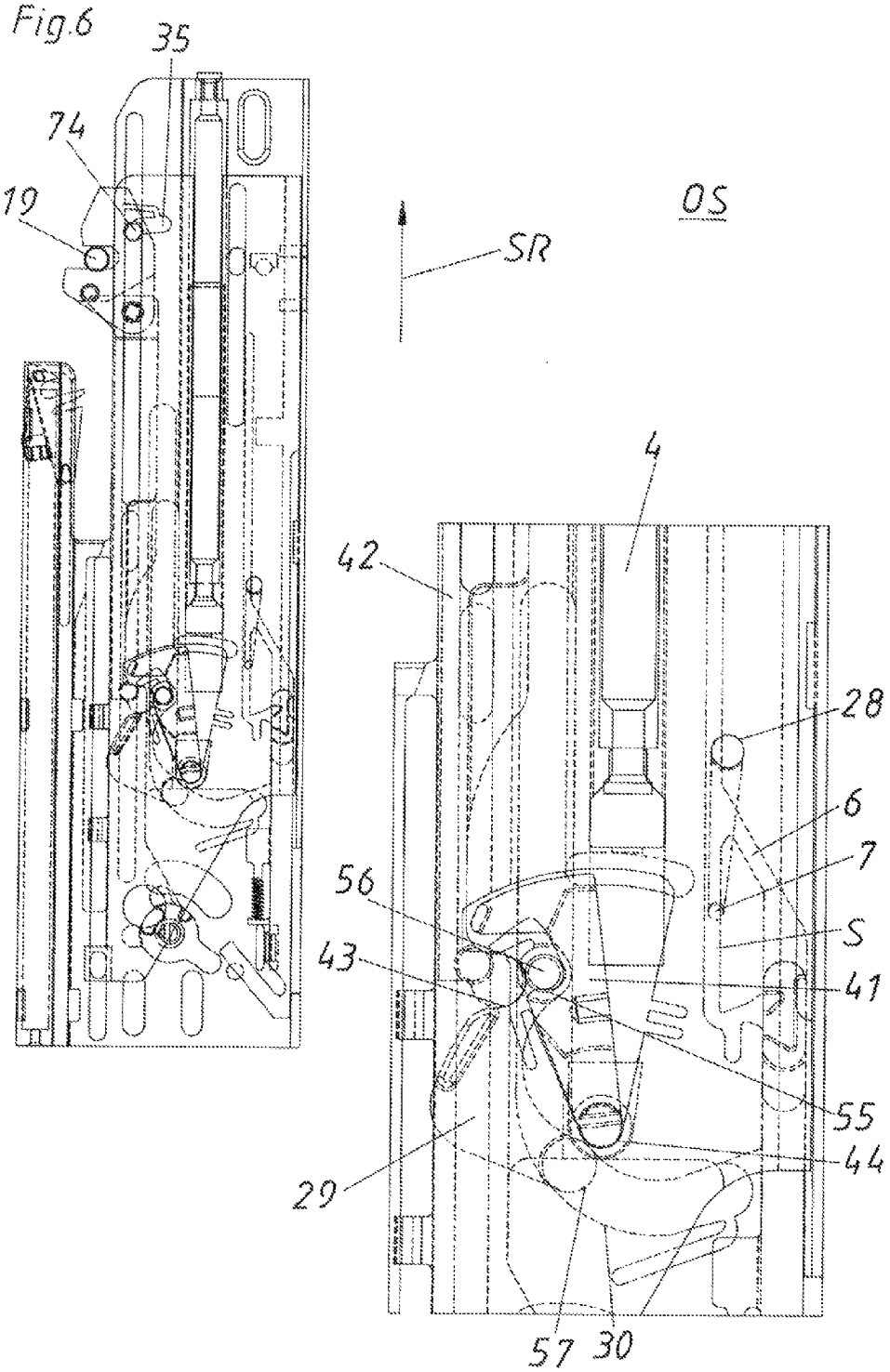

If now as shown in FIG. 6, the moveable furniture part 2 is moved together with the drive device 1 in the closing direction SR, then the coupling element 23 comes into abutment with the entrainment portion 19 which is fixed with respect to the carcass. As a result, by virtue of the configuration of the coupling element guide path 35 and the guide element 74 guided therein the coupling element 33 is pivoted about the pivot axis 73 and the entrainment portion 19 is caught in the catch region 34 of the coupling element 33. The coupling element 33 has already moved together with the transmission element 42 as shown in FIG. 6 by a considerable distance relative to the FIG. 5 position, by virtue of the manual closing movement of the moveable furniture part 2 in the closing direction SR. The control element 29 is also moved by that movement, by way of the abutment 43. As once again the stressing element 56 is provided on that control element 29, the connecting element 41 is also moved by way of the stressing abutment 55. As that connecting element 41 is again mounted in the rotary bearing 44 on the slider 15 the entire slider 15 and therewith the ejection element 3 are displaced relative to the base plate 14, with stressing of the ejection force accumulator 4. By virtue of that displacement, the locking pin 7 also already passes further along the stressing portion S into the proximity of the transitional region Ü. It can also already be seen from FIG. 6 that the control element 29 pivots slightly by way of the guide element 57 and the control element guide path 30.

Figure 7:
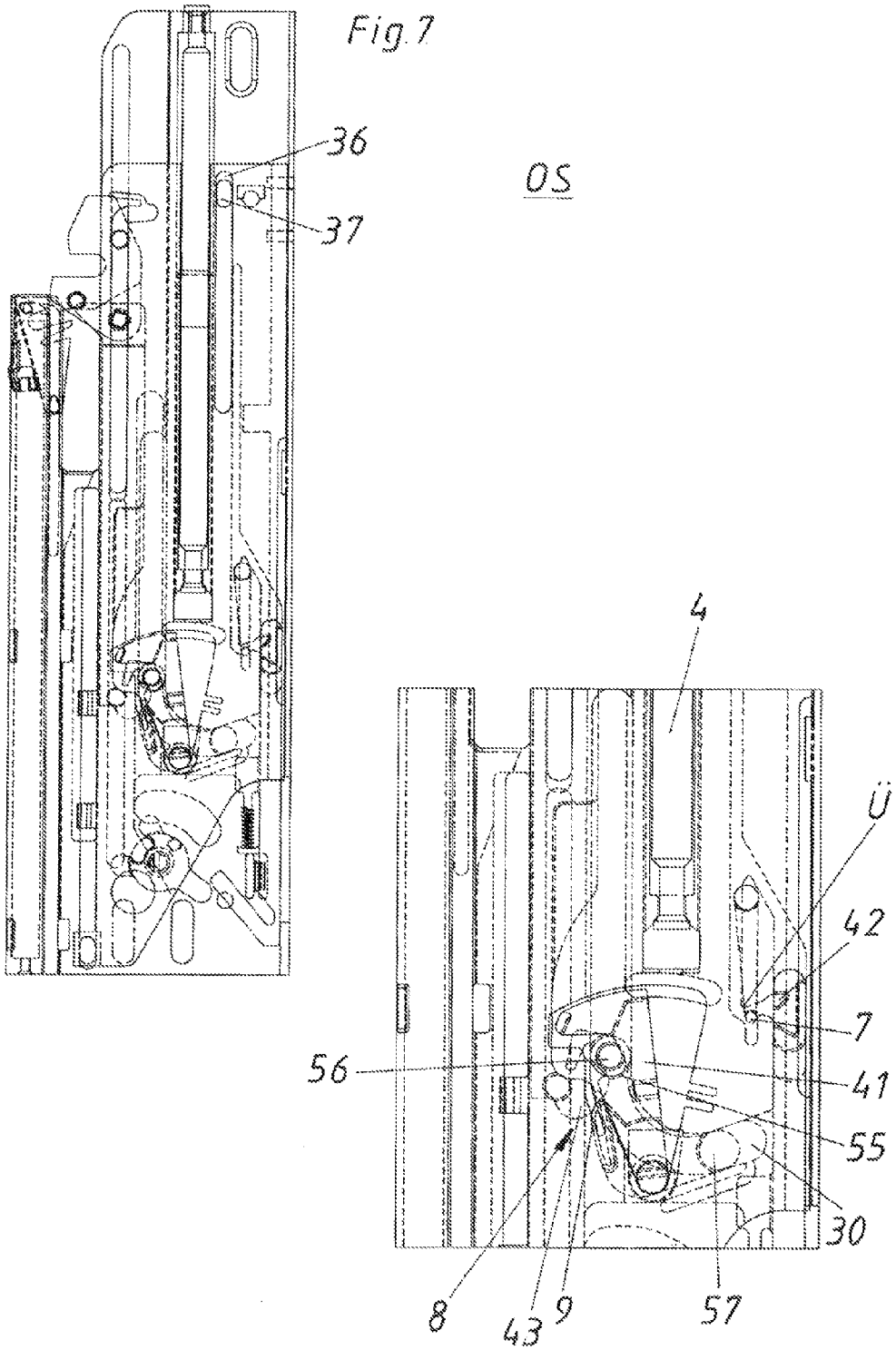

Referring to FIG. 7, that pivotal movement of the control element 29 has already further continued, whereby the abutment 43 of the transmission element 42 has already moved along the control cam 9 on the control element 29. At the same time the locking pin 7 has also already moved beyond the transitional region Ü and is at the beginning of the latching engagement movement region E. In previous embodiments, at that moment the ejection element 3 and the slider 15 were uncoupled from the pressing movement of an operator and the slider 15 was free. As a result, the full ejection force of the ejection force accumulator 4 could act on the locking pin 7 and move the pin 7 quickly and with a large amount of force along the latching engagement movement region E into the latching region R. As a result, in previous embodiments, there was the disadvantage of a large amount of noise being produced and a severe loading on the parts of the locking device 5. In comparison, it will be seen from FIG. 7 that the slider 15 was admittedly already slightly decoupled from the transmission element 42 and its abutment 43 by the ejection force accumulator 4, but entire decoupling has not yet occurred by virtue of the configuration of the control cam 9. Rather, the abutment 43 and the control cam 9 form a travel transmission mechanism and thereby a kind of damping device 8 for the locking pin 7. As a result, the kinetic energy operative from the ejection force accumulator on the locking pin 7 increases only slowly.

Figure 8:
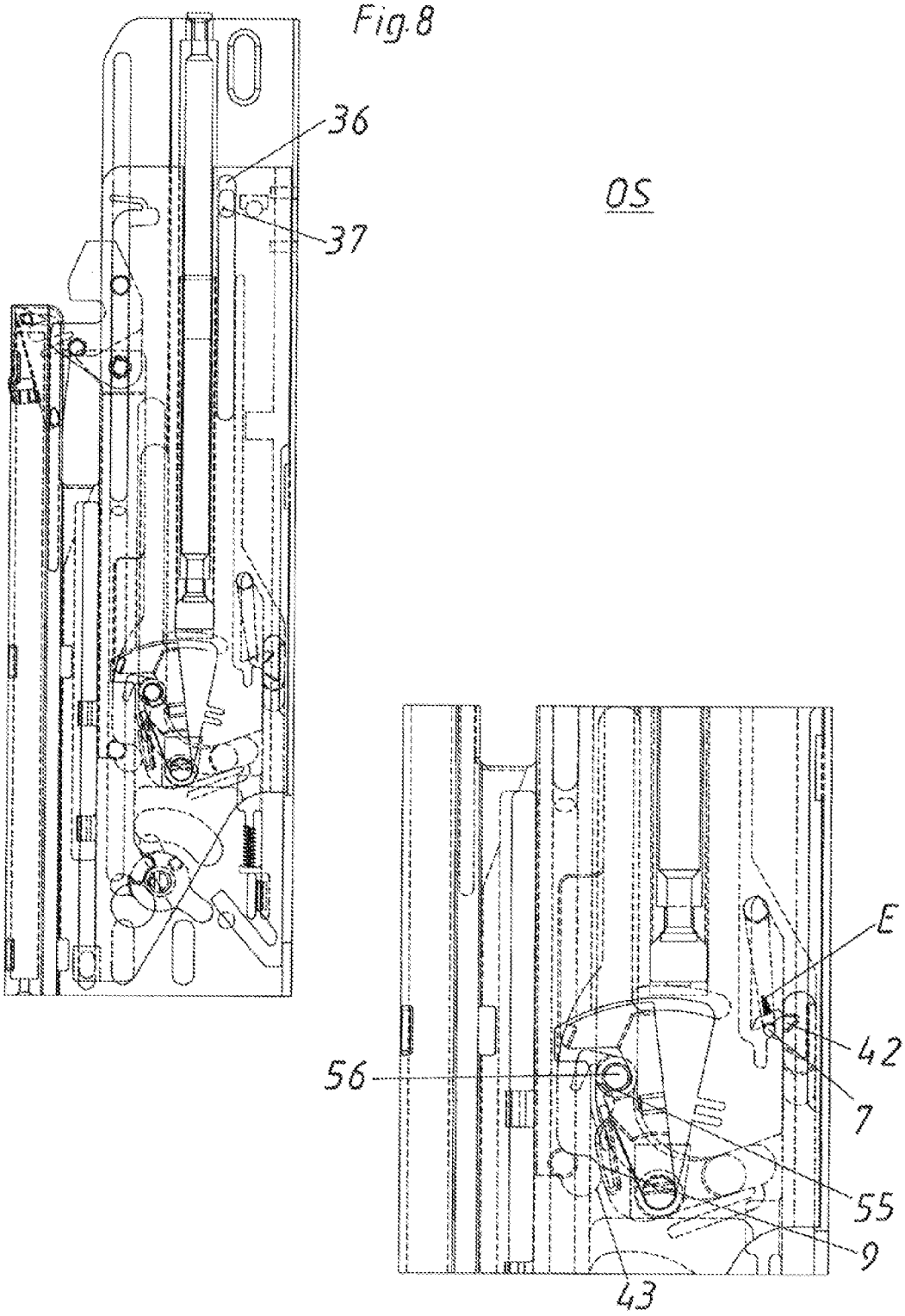

This can also be seen from FIG. 8, wherein the abutment 43 has again moved further along the control cam 9 and at the same time there has been a further movement of the locking pin 7 in the latching engagement movement region E. The fact that the ejection force accumulator 4 has already moved the slider 15 again relative to the base plate 14 can also be seen from the fact that the slider path limiting means 37 has moved relative to the slider path 36, in relation to FIG. 7.

Figure 9:
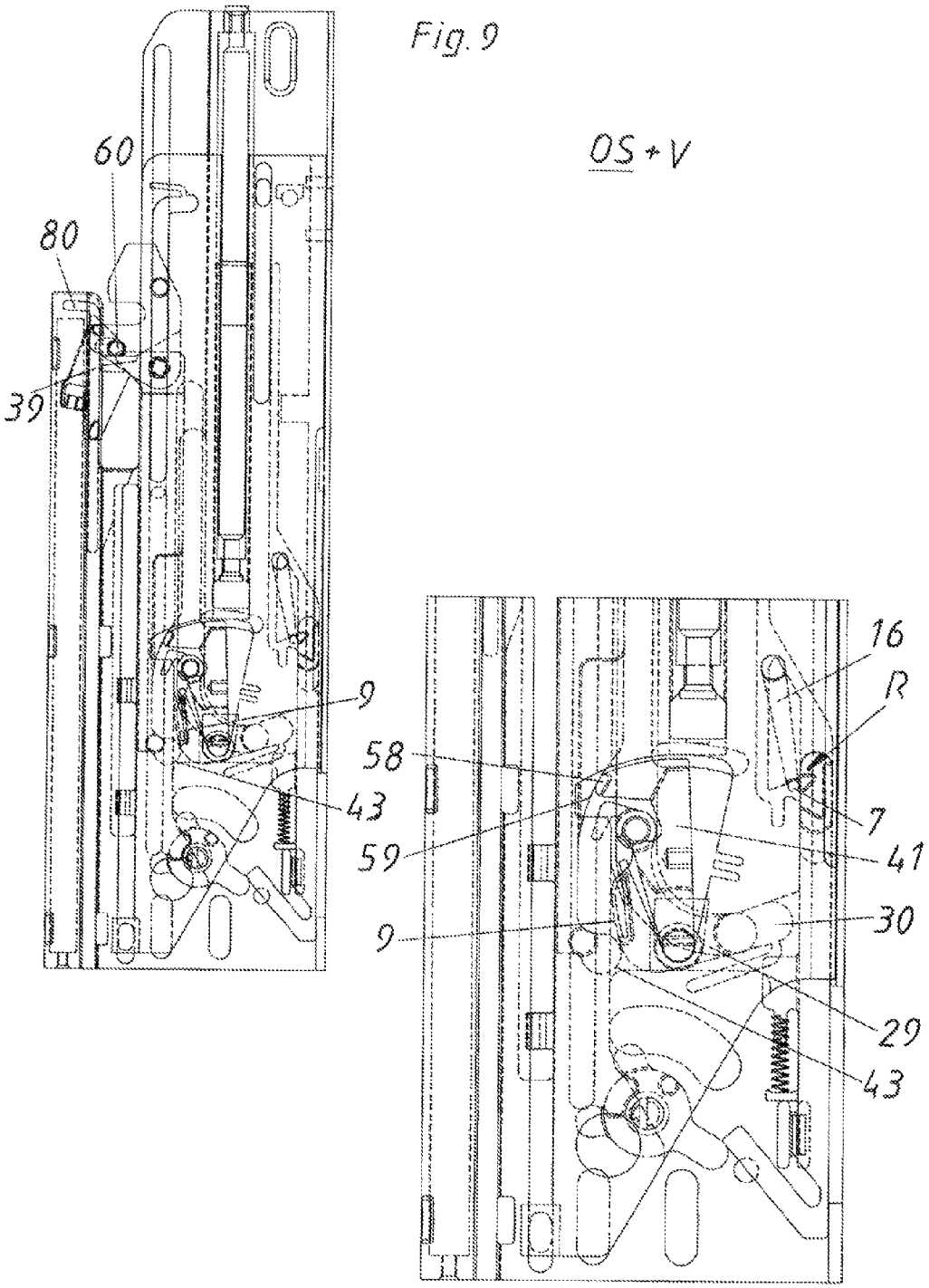
Figure 10:
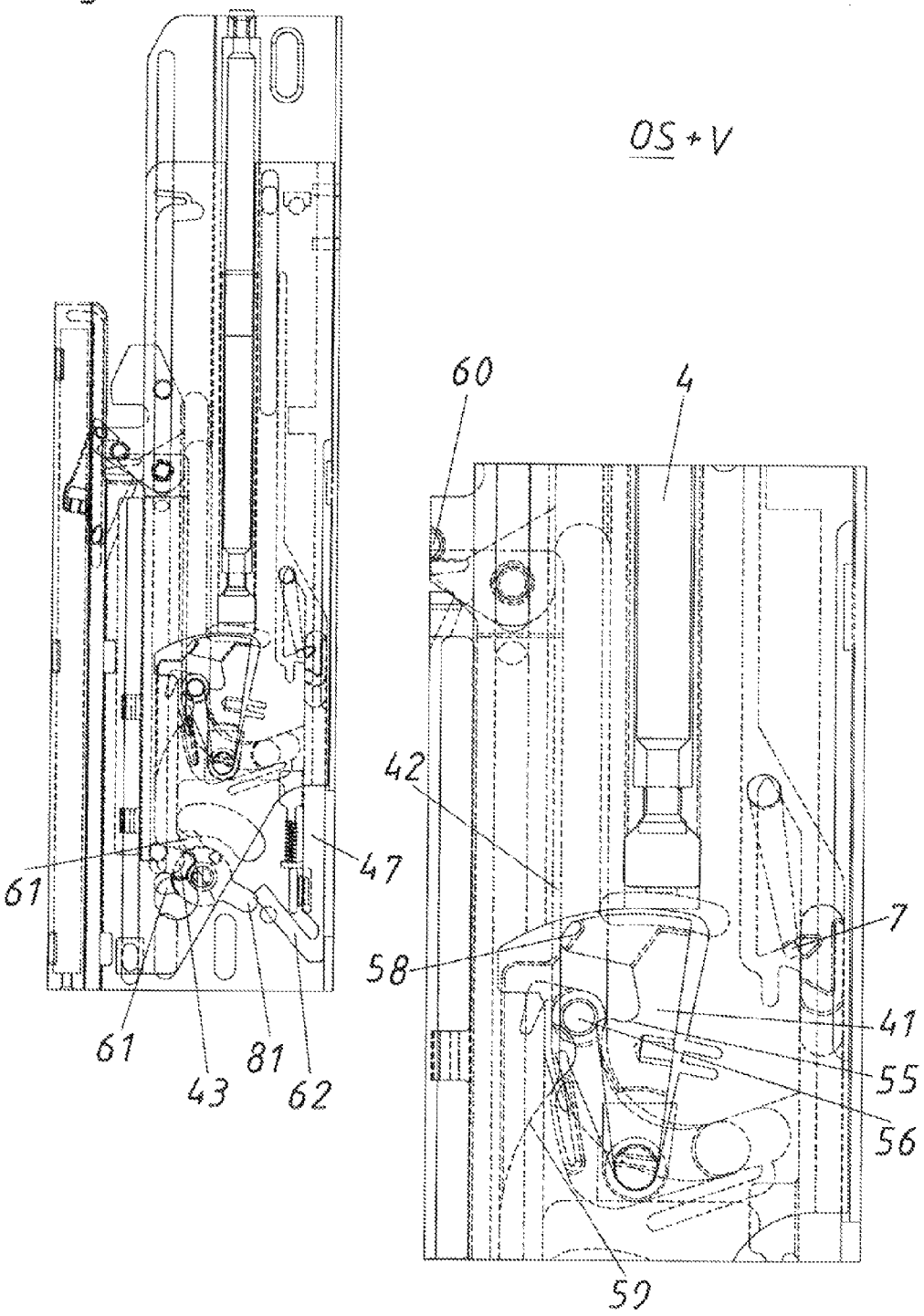

In FIG. 9 there is no longer any contact between the abutment 43 and the control cam 9 of the control element 29 whereby the full force of the ejection force storage means 4 is acting on the locking pin 7 by the slider 15, the rotary bearing 28, and the locking lever 16. As, at the moment of full force being exerted by the ejection force accumulator 4 on the locking pin 7, that locking pin 7 however is already in the latching region R, no loud noises are produced and there is no heavy wear. In that position as shown in FIG. 9, the control element 29 is loose and is not subjected to force in the control element guide path 30. It will further be seen that, by virtue of the further movement of the transmission element 42, the connecting element 41 pivots in the clockwise direction against the force of the compression spring (not shown). That takes place as the diversion abutment 58 on the connecting element 41 is moved or diverted by the diversion surface 59 on the transmission element 42. It can further be seen from FIG. 9 that the locking device 5 is admittedly already in the locking position V, but the moveable furniture part 2 is still in an open position OS. By virtue of the manual closing movement, however, the coupling element 33 has already moved relative to the base plate 14 to such an extent that the retraction coupling element 39 has moved out of the angled end portion 80 of the retraction device 25 so that the retraction coupling element 39 is coupled to the coupling pin 60 on the coupling element 33. Because the retraction coupling element 39 is now no longer in the angled end portion 80 the retraction force accumulator 40 can also be relieved of stress, contracting as it does so, so that the entire moveable furniture part 2 is further moved in the closing direction SR and reaches the position shown in FIG. 10. That position corresponds to a position shortly before reaching the closed position SS. It will also be seen from this FIG. 10 that, by virtue of the further movement of the transmission element 42 relative to the slider 15, the connecting element 41 has been further pivoted in the clockwise direction by the diversion abutment 58. As a result, the stressing element 56 of the control element 29 comes out of engagement with the stressing abutment 55 of the connecting element 41. FIG. 10 further shows that the abutment 43 of the transmission element 42 is now between the limiting elements 61 of the first pulling triggering element 46, wherein the arm 81 of the first pulling triggering element 46 bears laterally against the elastic arm 62 of the second pulling triggering element 47.

Figure 11:
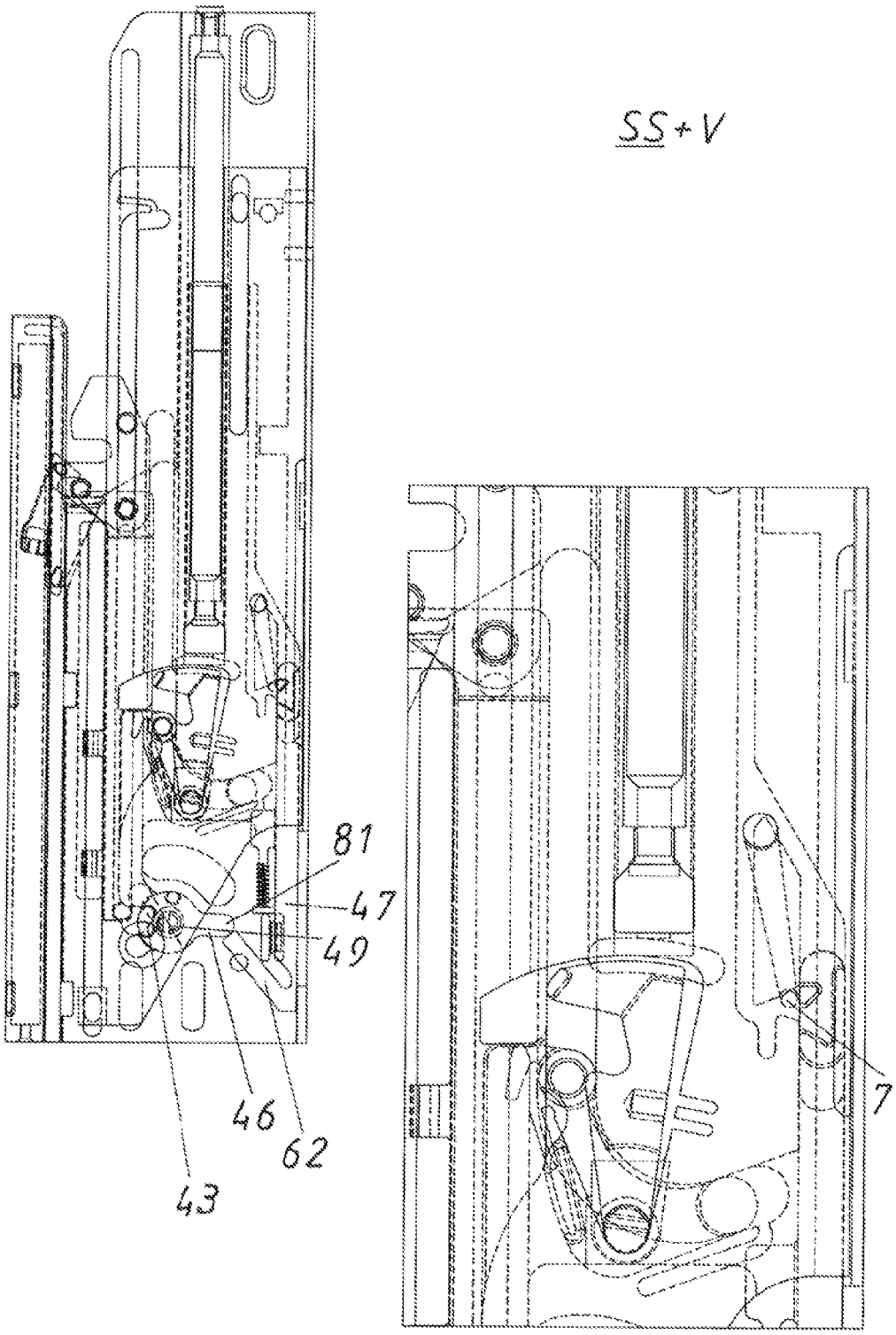

When now the retraction force accumulator 40 is relieved of stress as shown in FIG. 11 the closed position SS as shown in FIG. 11 is reached. As shown in FIG. 11, the first pulling triggering element 46 has also rotated about the rotary bearing 49 in the counter-clockwise direction by virtue of the pressure exerted by way of the abutment 43 and the transmission element 42, wherein the arm 81 now bears against the front side of that elastic arm 62, with flexing of the elastic arm 62.

Figure 12:
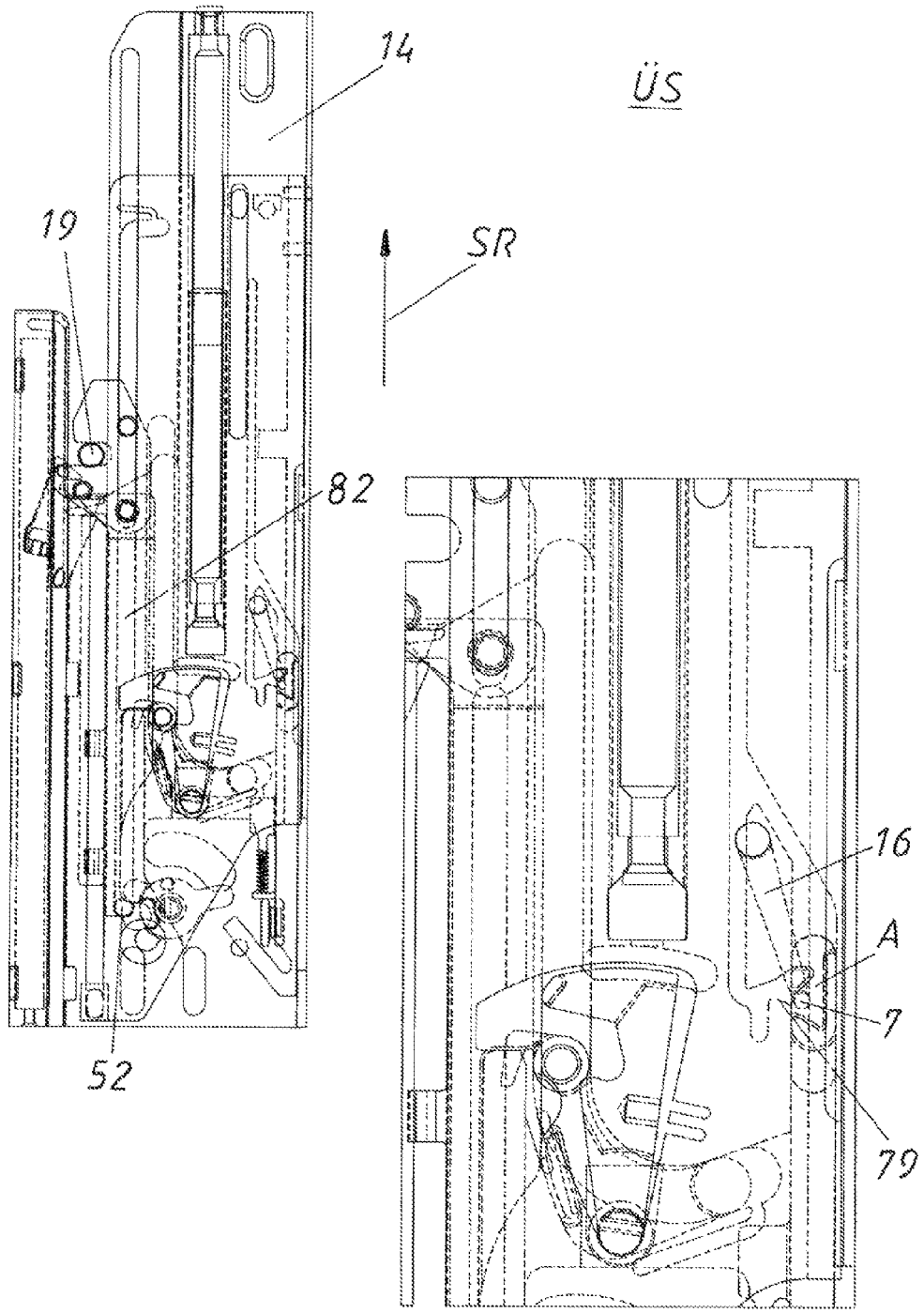

If now a pressing force is applied to the moveable furniture part 2 in the closing direction SR starting from that closed position SS as shown in FIG. 11, then the moveable furniture part passes into the over-pressing position ÜS as shown in FIG. 12. As the transmission element 42 has already reached the end of the path in the slider 15 by the guide limiting means 52 as shown in FIG. 11, then in the over-pressing situation the entire slider 15 is moved relative to the base plate 14, whereby the locking pin 7 also passes out of the latching region R into the ejection portion A by way of the diversion surface 79.

Figure 13:
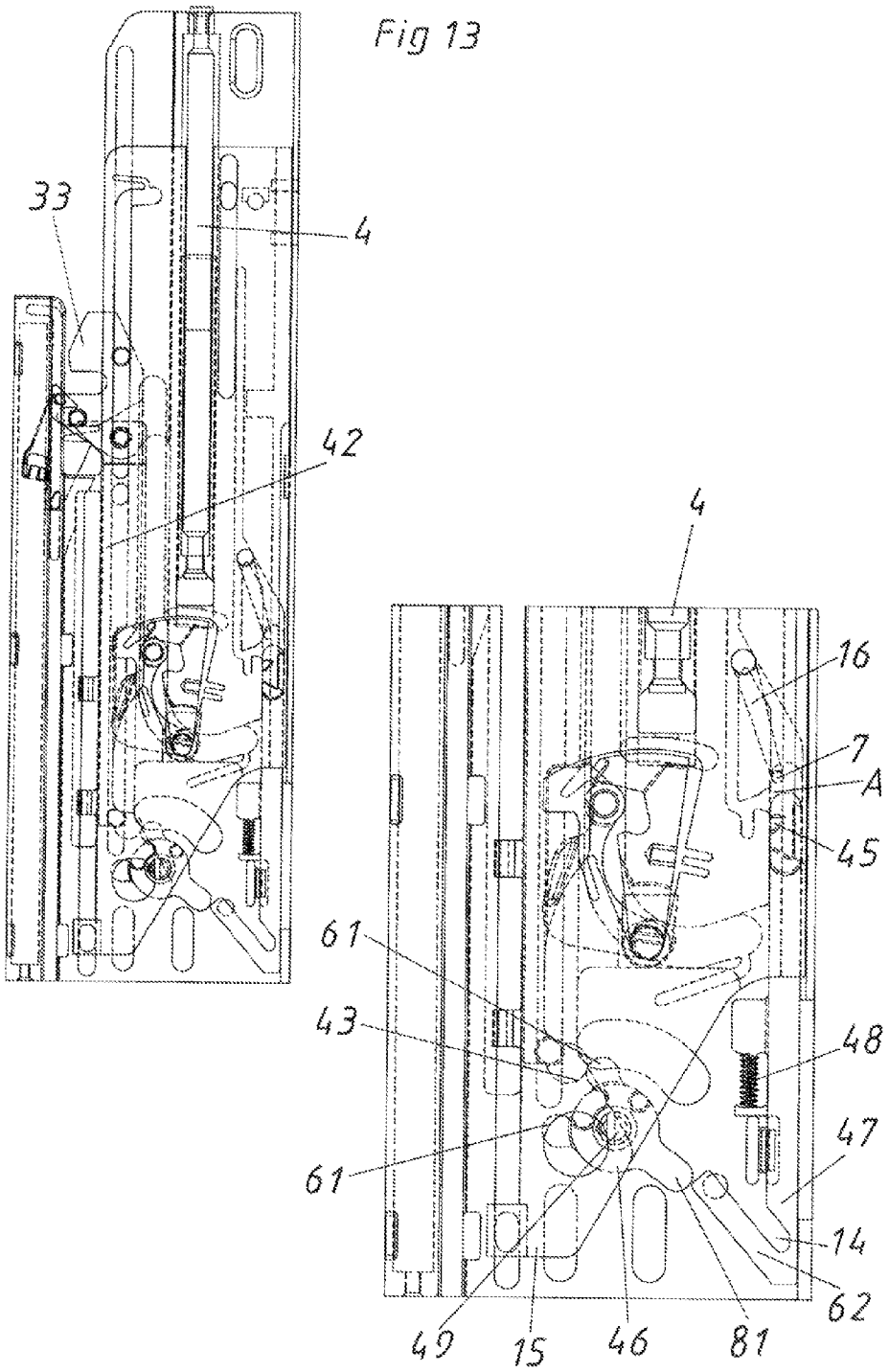

As an alternative thereto, as shown in FIG. 13, unlocking can also be effected by pulling. In that case, starting from the position shown in FIG. 11, the moveable furniture part 2 is pulled, in which case the transmission element 42 and its abutment 43 are moved relative to the slider 15 by way of the coupling element 33. As the abutment 43 as shown in FIG. 11 is still caught between the limiting elements 61, the first pulling triggering element 46 is rotated in the clockwise direction about the rotary bearing 49 by that pulling movement. As the arm 81 of that first pulling triggering element 46 bears against the end of the elastic arm 62—which, when it is acted upon with force by that end does not elastically yield but remains stiff—of the second pulling triggering element 47, that pulling triggering element 47 is moved relative to the base plate 14 against the force of the spring 48 which is compressed in FIG. 13, whereby the locking abutment 45 also moves away from the latching region R. As a result, the locking pin 7 is no longer held or locked in the latching region R and it passes into the ejection portion A by virtue of the spring force of the ejection force storage means 4.

Figure 14:
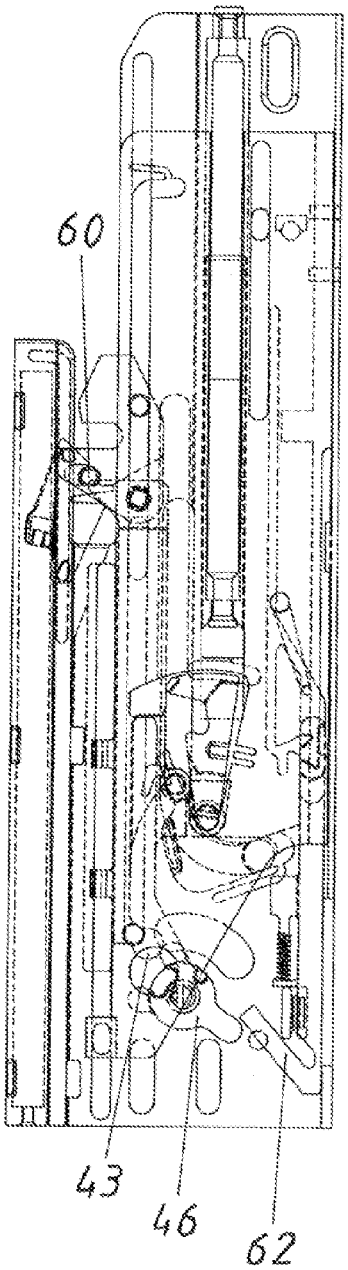
Figure 14:
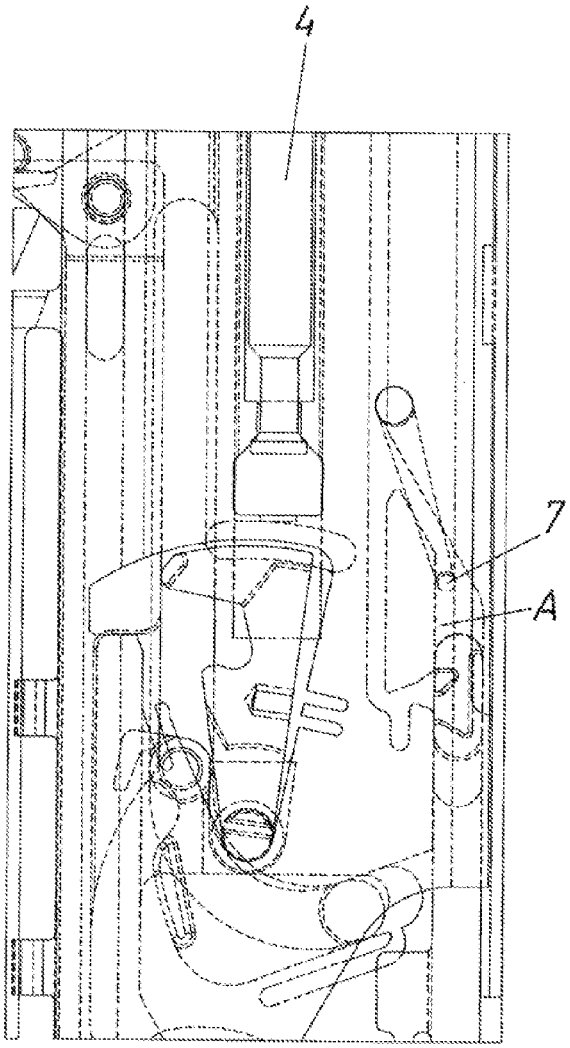
Figure 15:
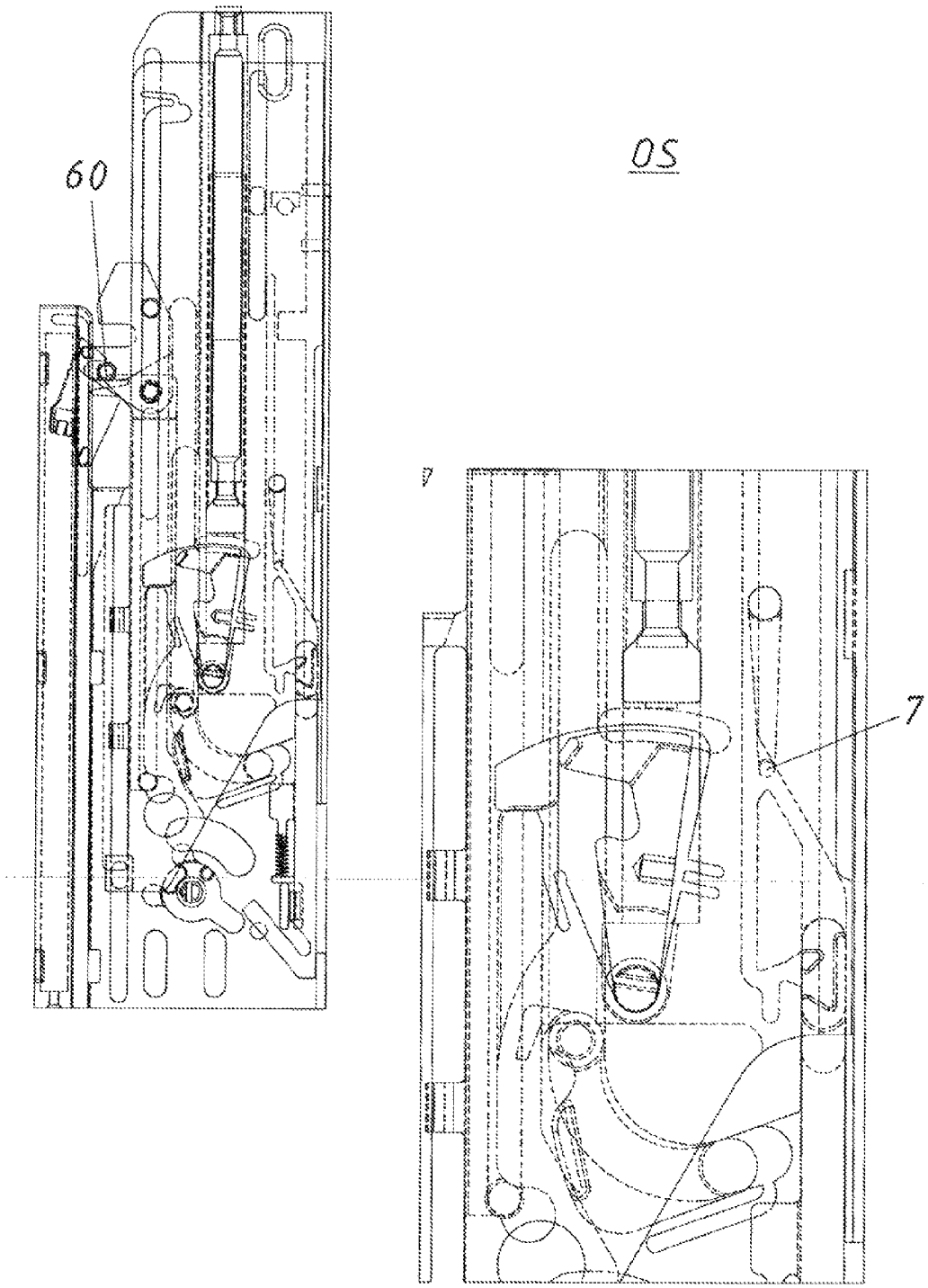

Irrespective of whether the locking device 5 was unlocked by pulling or by over-pressing, the drive device 1 then at any event passes into the open position OS as shown in FIG. 14. With that movement, the first pulling triggering element 46 is also further rotated in the clockwise direction by way of the abutment 43, whereby the second pulling triggering element 47 is moved against the force of the spring 48 until the first pulling triggering element 46 passes into the position shown in FIG. 14.

During that ejection movement, the retraction force accumulator 40 of the retraction device 25 is also stressed by way of the coupling pin 16. The locking pin 7 passes into the stressing portion S again (see FIG. 15).

Figure 16:
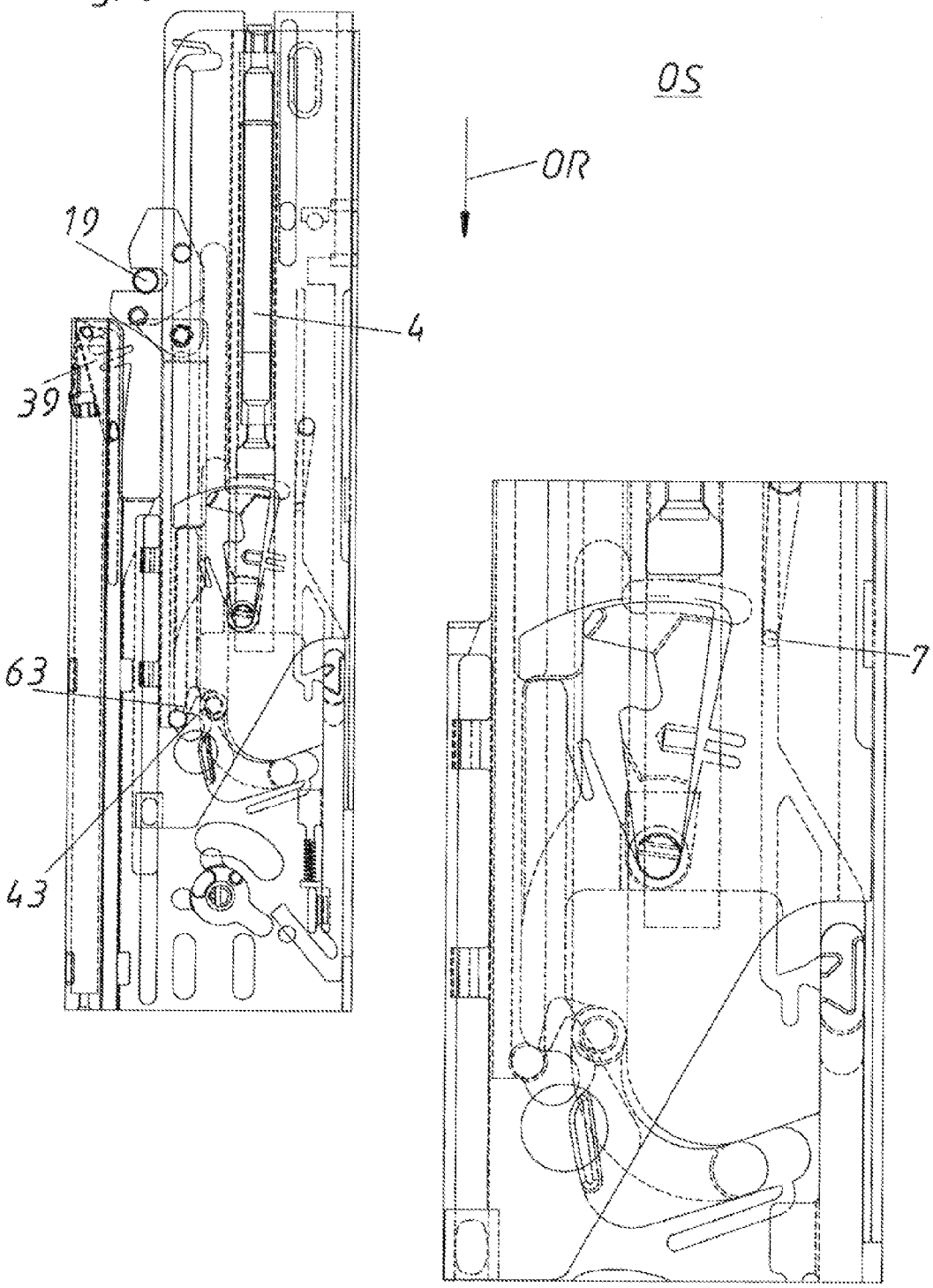

In FIG. 16 the retraction coupling element 39 is again uncoupled from the coupling pin 60 of the coupling element 33 and the retraction coupling element 39 is held in the angled end portion 80 with the retraction force accumulator 40 in the stressed condition. In FIG. 16, the ejection force accumulator 4 is not yet entirely relieved of stress.

Figure 17:
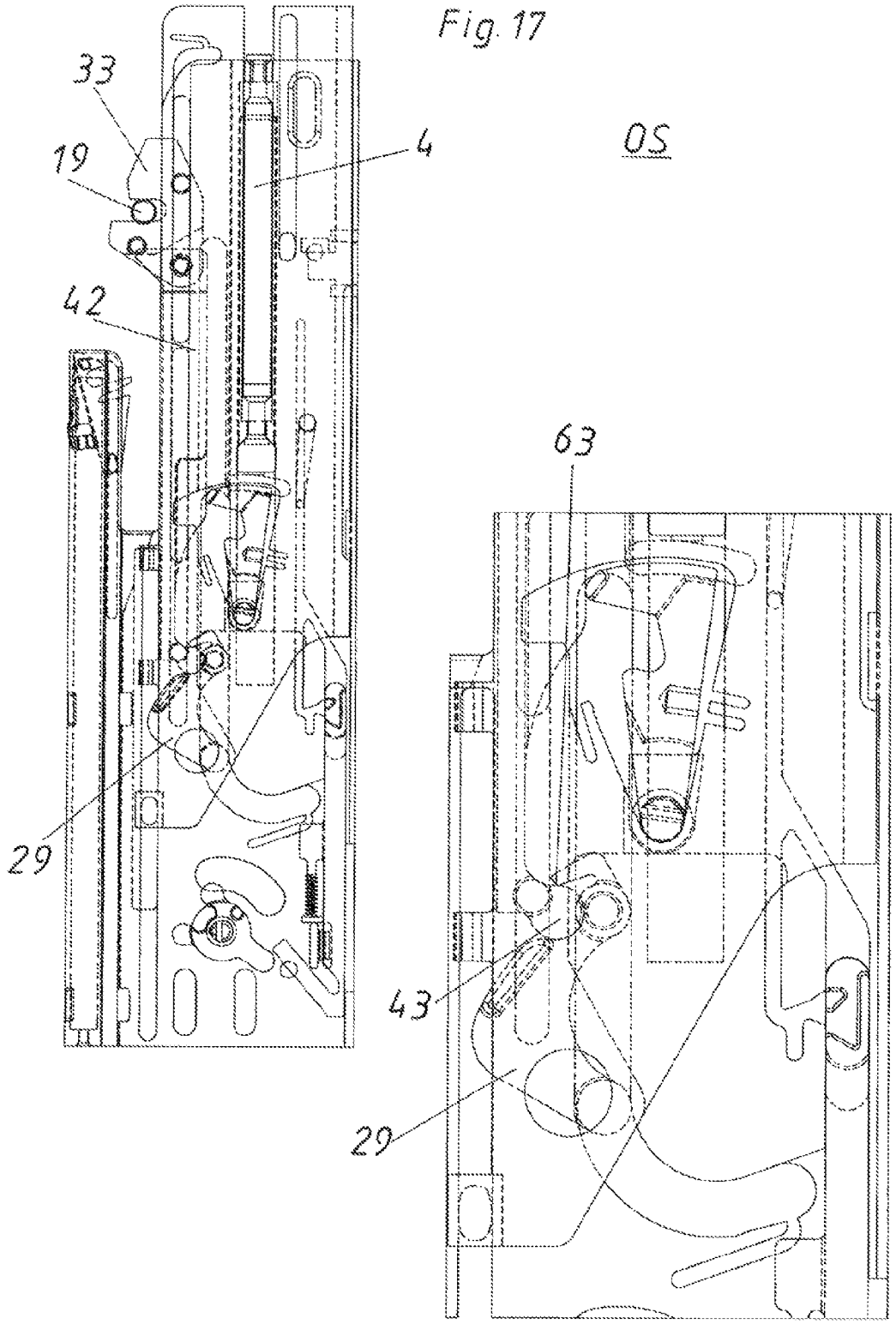

In FIG. 17, however, the ejection force accumulator 4 has been relieved of stress to such an extent that now the slider 15 bears against the base plate 14 by way of the slider path 36 and the slider path limiting means 37, in an end position. The moveable furniture part 2 is now freely moveable or for example can move still further in the opening direction OR due to the inertia triggered by the ejection force accumulator 4. As the entrainment portion 19 is still held in the catch region 34 of the coupling element in the further movement in the opening direction OR the coupling element 33 together with the transmission element 42 is moved further relative to the slider 15, in which case the abutment 43 already comes into contact with the abutment 63 on the control element 29, as shown in FIG. 16, whereby the control element 29 is also moved along the control element guide path 30 by the transmission element 42 relative to the slider 15.

Figure 18:
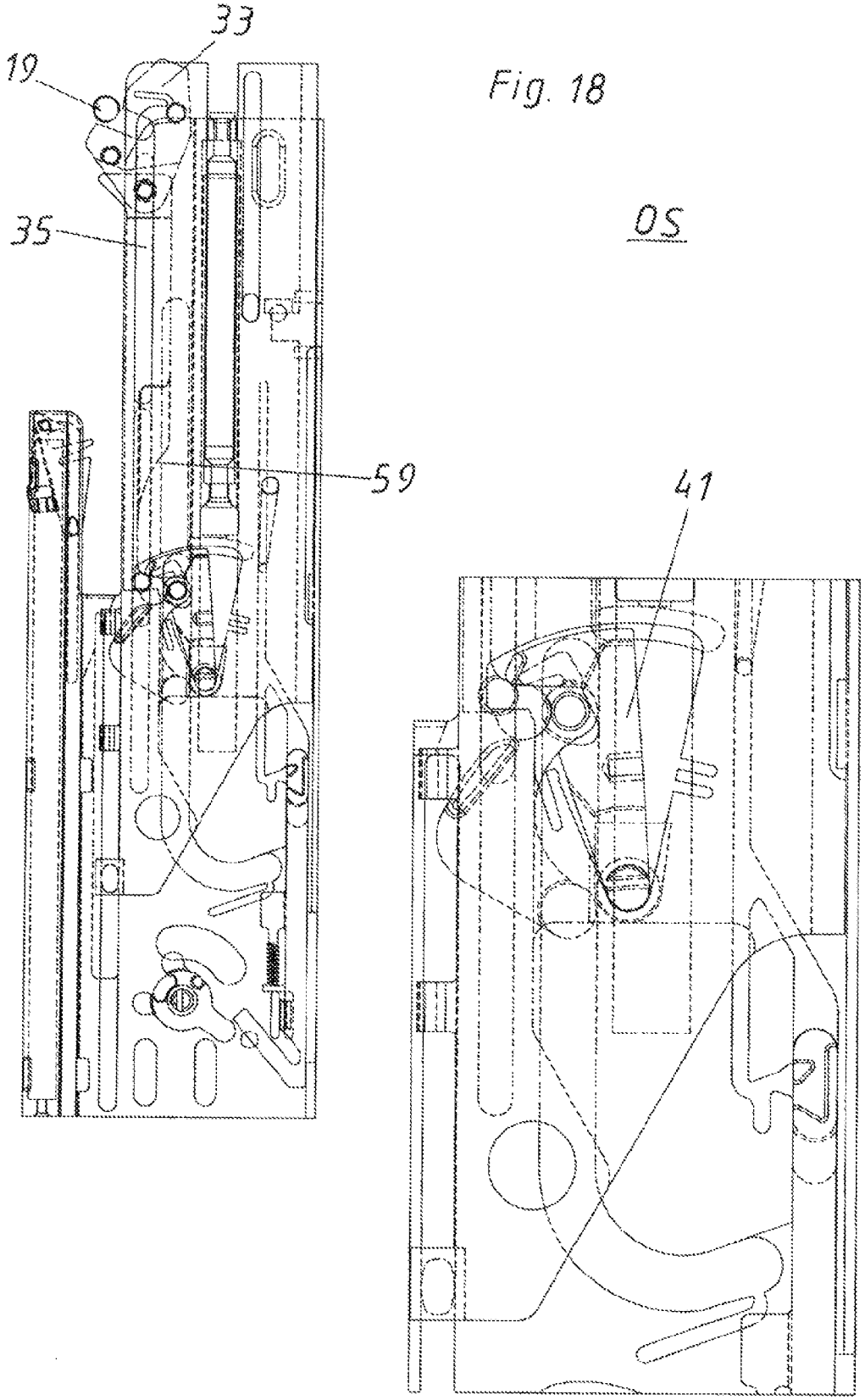

As shown in FIG. 18 the transmission element 42 has moved relative to the slider 15 until the control element 29 is again at the height of the connecting element 41. At the same time, the spring (not shown) between the connecting element 41 and the slider 15 has also been relieved of stress by virtue of the diversion abutment 58 which is no longer deflected by the diversion surface 59. In FIG. 18, the coupling element 33 has also reached the angled end portion of the coupling element guide path 35 so that the coupling element 33 has been pivoted about the pivot bearing 73 so that the entrainment portion 19 is released from the catch region 34 of the coupling element 33. The initial position shown in FIG. 5 is thus restored.

Figure 32:
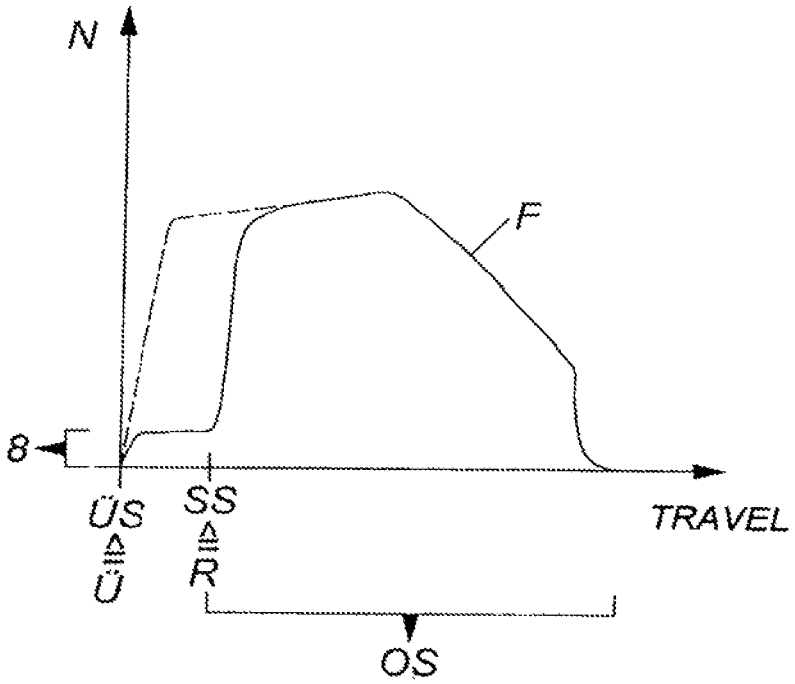
FIG. 32 is a graph illustrating the spring force of the ejection force storage means matching the first variant.
Figure 33:
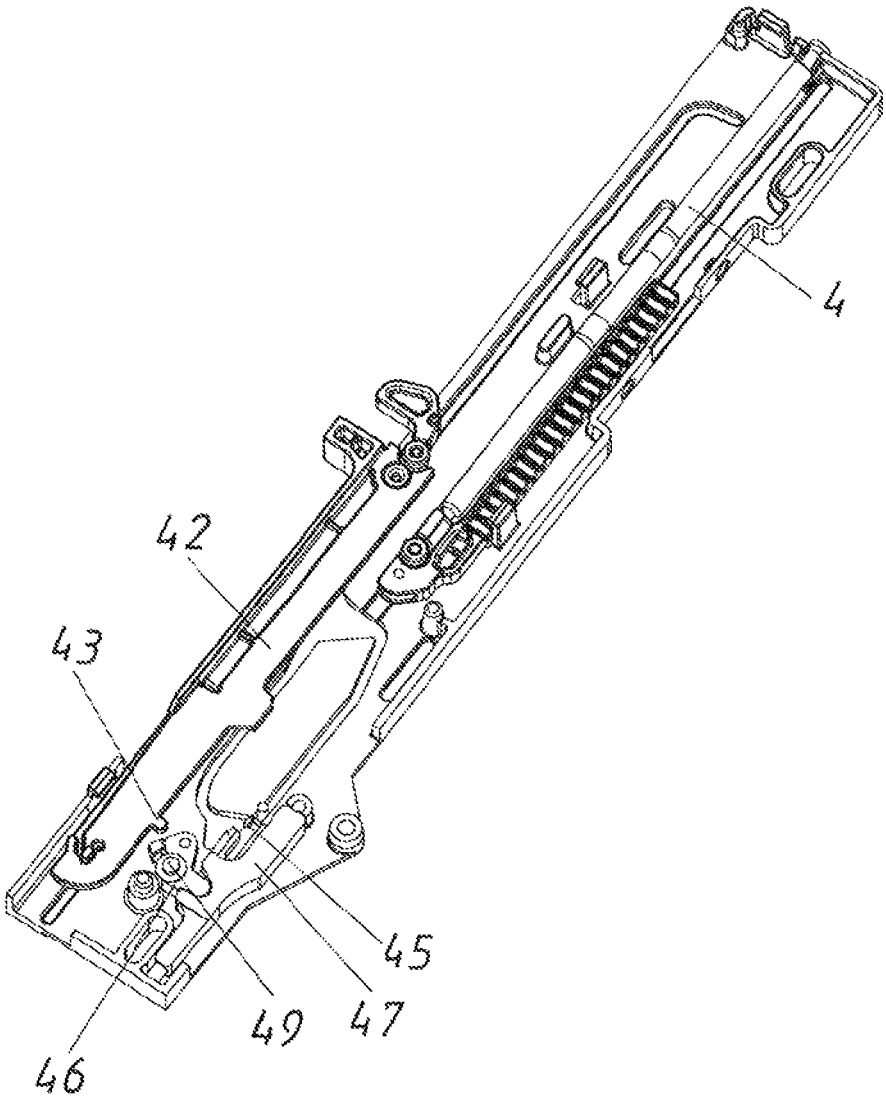
FIGS. 33 through 40 show further examples for triggering by pulling.

Another way of not immediately causing the entire force of the ejection force accumulator 4 to act on the locking pin 7—as in the case of the travel transmission mechanism—provides that the ejection force accumulator 4 itself is damped. For that purpose in particular in the first range of movement of the ejection force accumulator 4, acting in the opening direction OR, going from the over-pressing position ÜS to the closed position SS, a damping device 8 can reduce the transmission of force from the ejection force accumulator 4 to the slider 15. That is diagrammatically shown in FIG. 32. It will be seen from the graph in FIG. 32 how the spring force F of the ejection force accumulator 4 acts along the path of movement of the moveable furniture part 2. In normal ejection illustrated by the broken line, when the moveable furniture part 2 is released in the over-pressing position ÜS, a high force on the part of the ejection force accumulator 4 becomes free whereby the spring force F rises to a high Newton value N even before the closed position SS is reached. As the same applies for the transmission of force from the ejection force accumulator 4 to the locking pin 7 not only in the region between the over-pressing position ÜS and the closed position SS, but also for the substantially identical drawer travel movement region between the transitional region Ü and the latching region R, it will be apparent that, when the latching region R is reached by the ejection force accumulator 4, a very high spring force F acts on the locking pin 7 and on the guide path 6 in the latching region R, which can cause loud knocking noises. In order to reduce that high transmission of force in that latching engagement movement region E, either the travel transmission mechanism which has a damping effect in accordance with the first embodiment is provided or a damping device 8 (for example a linear damper) between the ejection force accumulator 4 and the slider 15 is provided. For example, that damping device 8 can be integrated into the ejection force accumulator 4 or connected in parallel therewith.

Figure 19A:
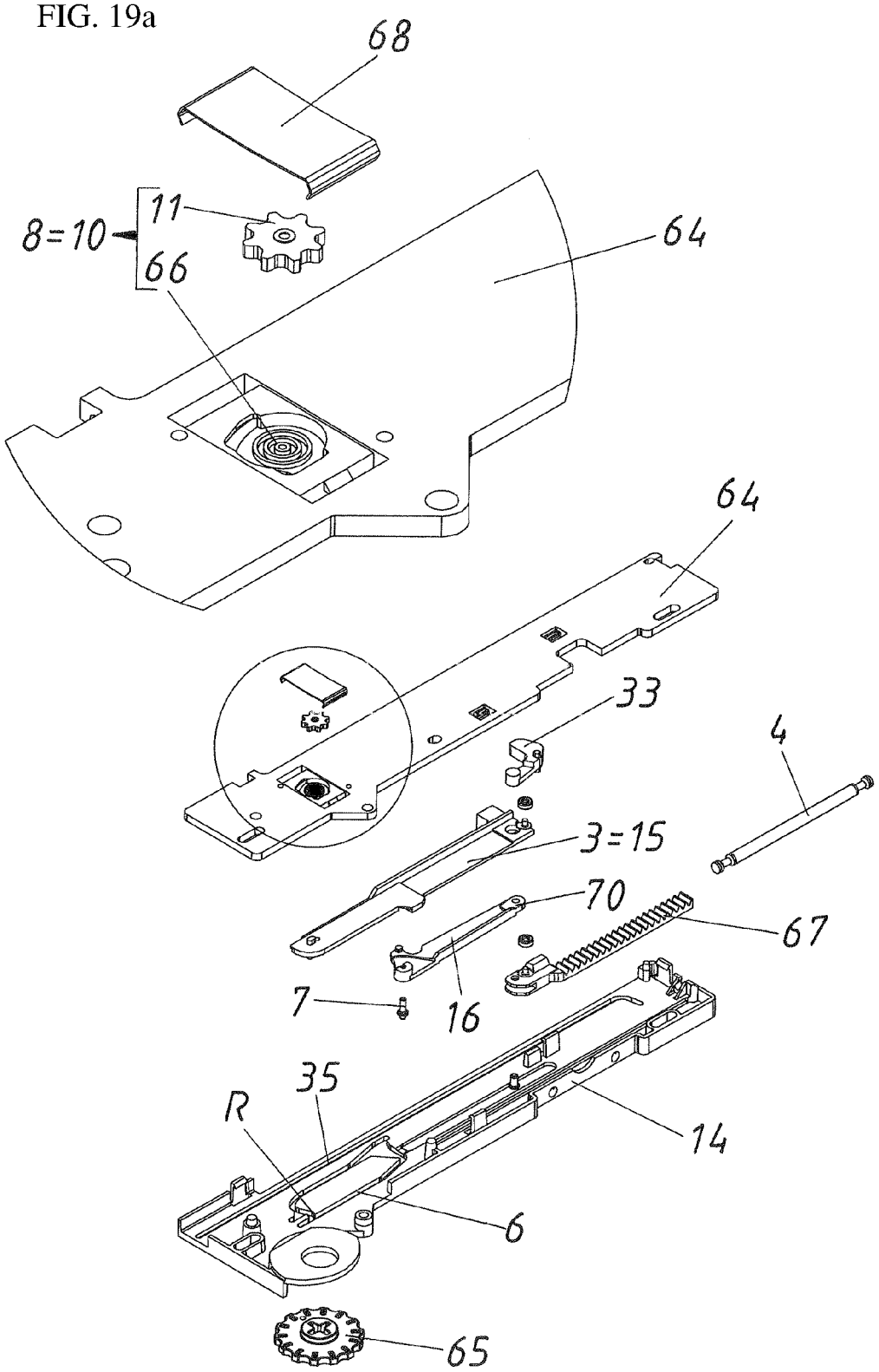
FIG. 19*a* is an exploded view of a second embodiment of the drive device.

A further embodiment of a drive device 1, in which the locking pin 7 can be placed in the latching region R in braked and/or damped relationship is shown as an exploded view in FIG. 19*a*. In this case once again, the guide path 6 with latching region R is provided in the base plate 14. That base plate 14 can be displaced relative to the moveable furniture part 2 by the depth adjusting wheel 65 so that it is possible to adjust the front panel gap. The ejection element 33 or the slider 15 is mounted displaceably relative to the base plate 14 along the coupling element guide path 35. The coupling element 33 is also mounted pivotably on the slider 15. In addition, the synchronization element 67 is also connected to the slider 15. Drive devices 1 arranged on opposite sides of the moveable furniture part 2 can be coupled or synchronized by way of that synchronization element 67. The locking lever 16 is mounted rotatably or pivotably to the slider 15 by the locking lever pivot bearing 70. The locking pin 7 is also fixed to the locking lever 16. The ejection force accumulator 4 is operative between the slider 15 and the base plate 14. In this embodiment, provided as an additional element is a base plate cover 64 in which the damping device 8 is provided. For that purpose, the base plate cover 64 has a gear rotary bearing 66 at which the gear 11 is rotatably mounted. That gear 11 and the gear rotary bearing 66 together with a damping medium therebetween form the rotational damper 10. To achieve a good connection between the gear 11 and the bearing 66 the arrangement has the holding element 68 which presses the gear 11 on to the bearing 66.

Figure 19B:
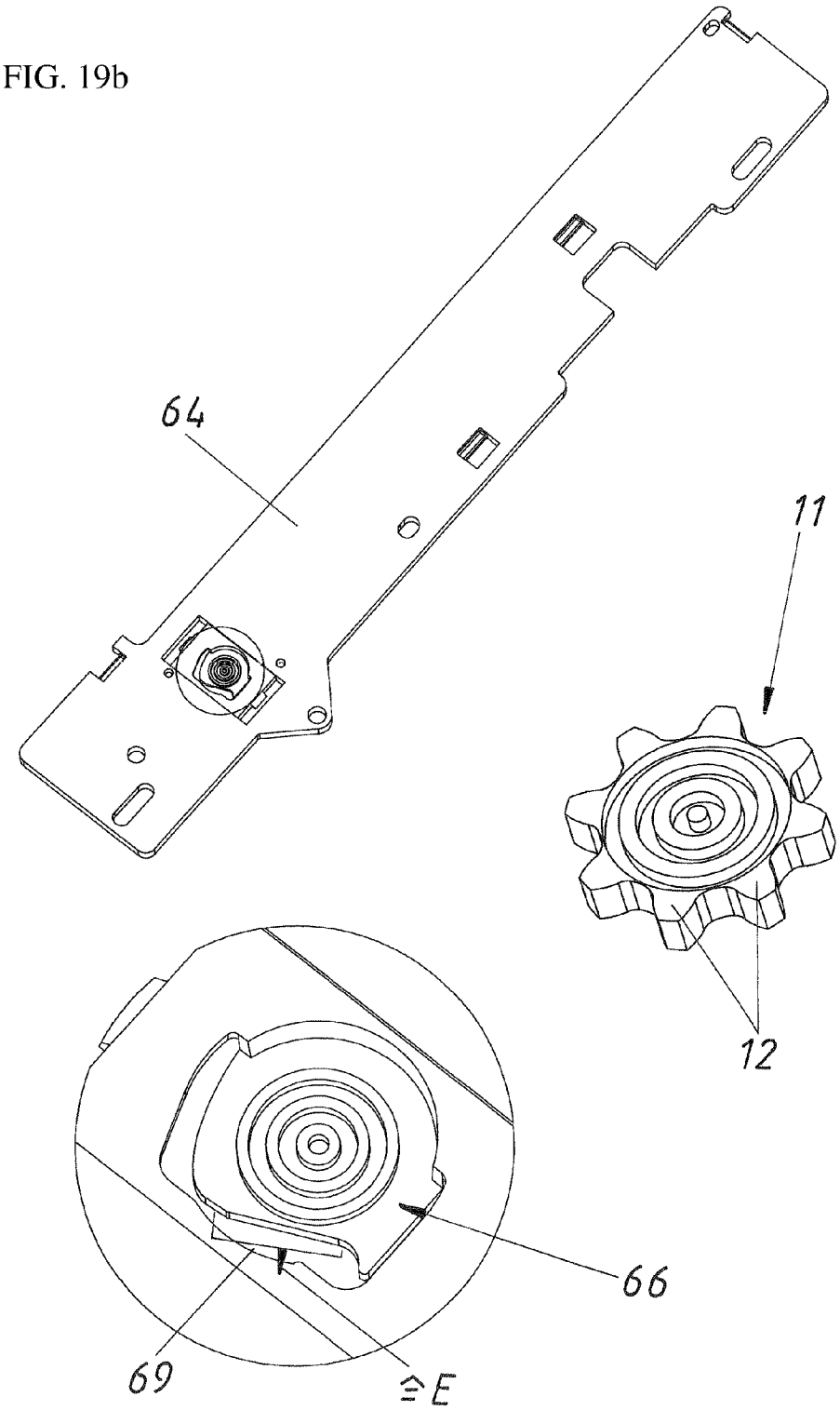
FIG. 19*b* shows details of the second drive device.

FIG. 19*b* is a detail view showing that the gear 11 and the bearing 66 have corresponding concentric grooves. To provide a good damping action a suitable, preferably viscous damping medium, for example Opanol, is present in or introduced into those grooves. It can also already be seen from FIG. 19*b* that an opening 69 is provided in the base plate cover 64. The edge of that opening 69 substantially coincides with a part of the guide path 6 and is provided sufficiently accurately opposite or above that region of the guide path 6 in the base plate 14, in the base plate cover 64. The edge of the opening 69 therefore also corresponds in a region thereof to the latching engagement movement region E, into which, in the assembled condition, a tooth 12 of the gear 11 projects.

Figure 20A:
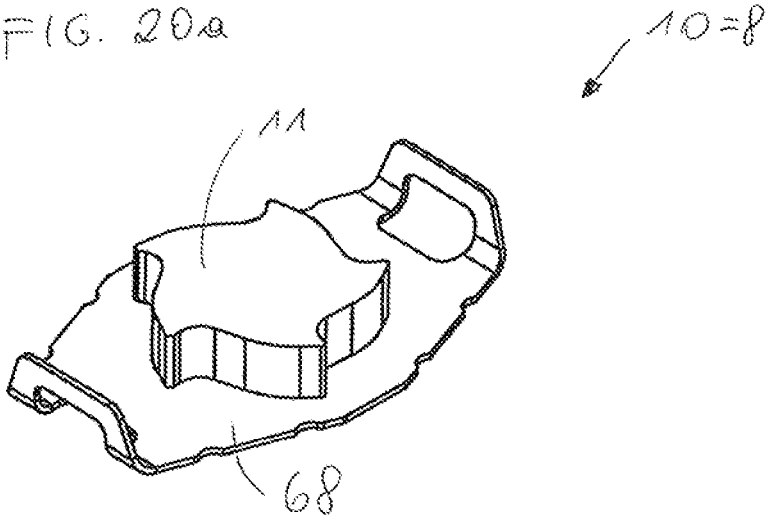
FIGS. 20*a*-20*g* show an embodiment of the damping device produced using two-component injection molding.
Figure 20B:
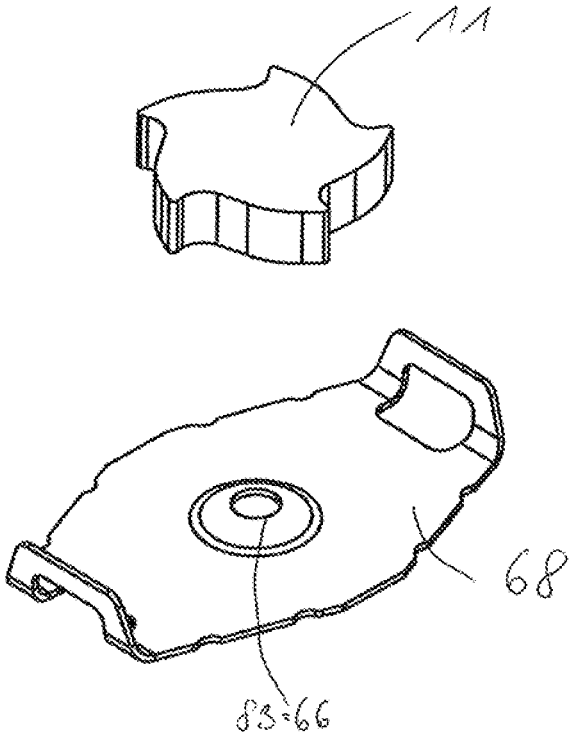
Figure 20C:
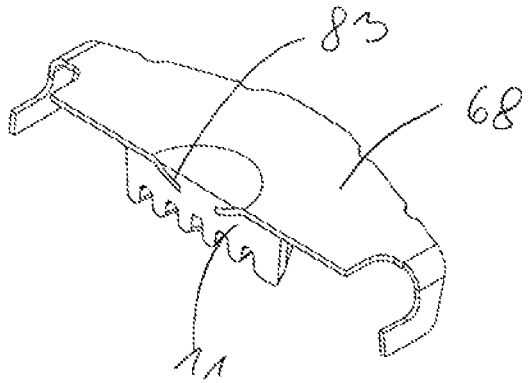
Figure 20D:
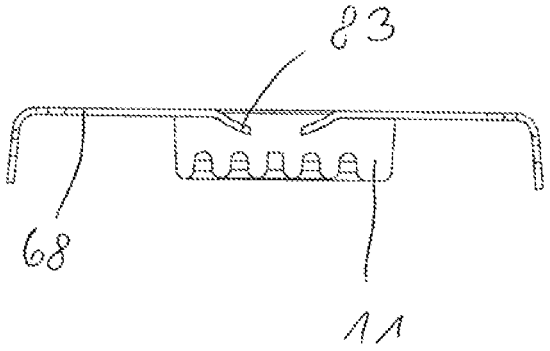
Figure 20E:
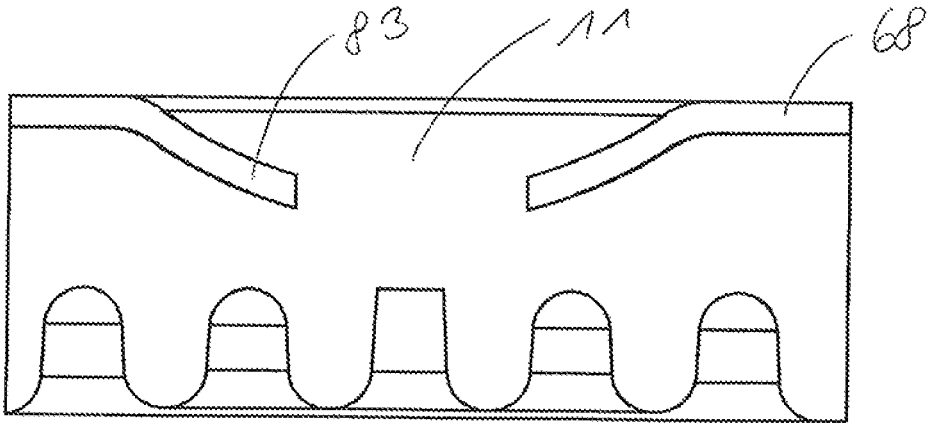
Figure 20F:
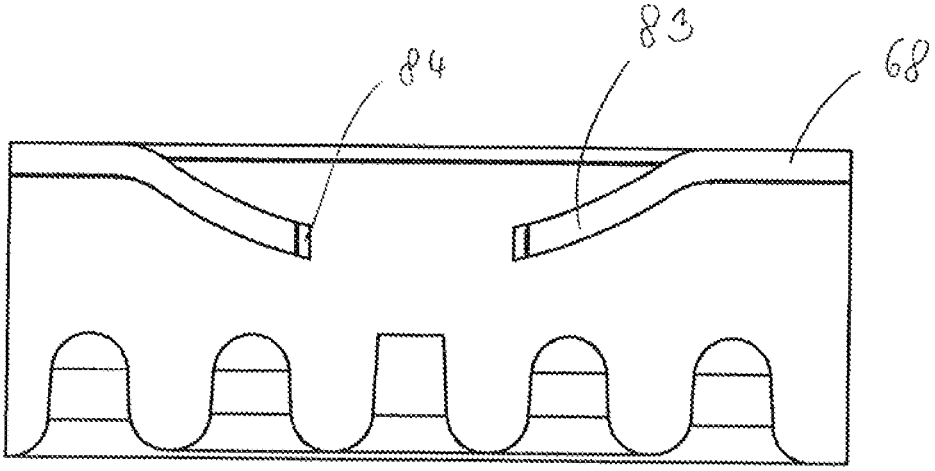
Figure 20G:
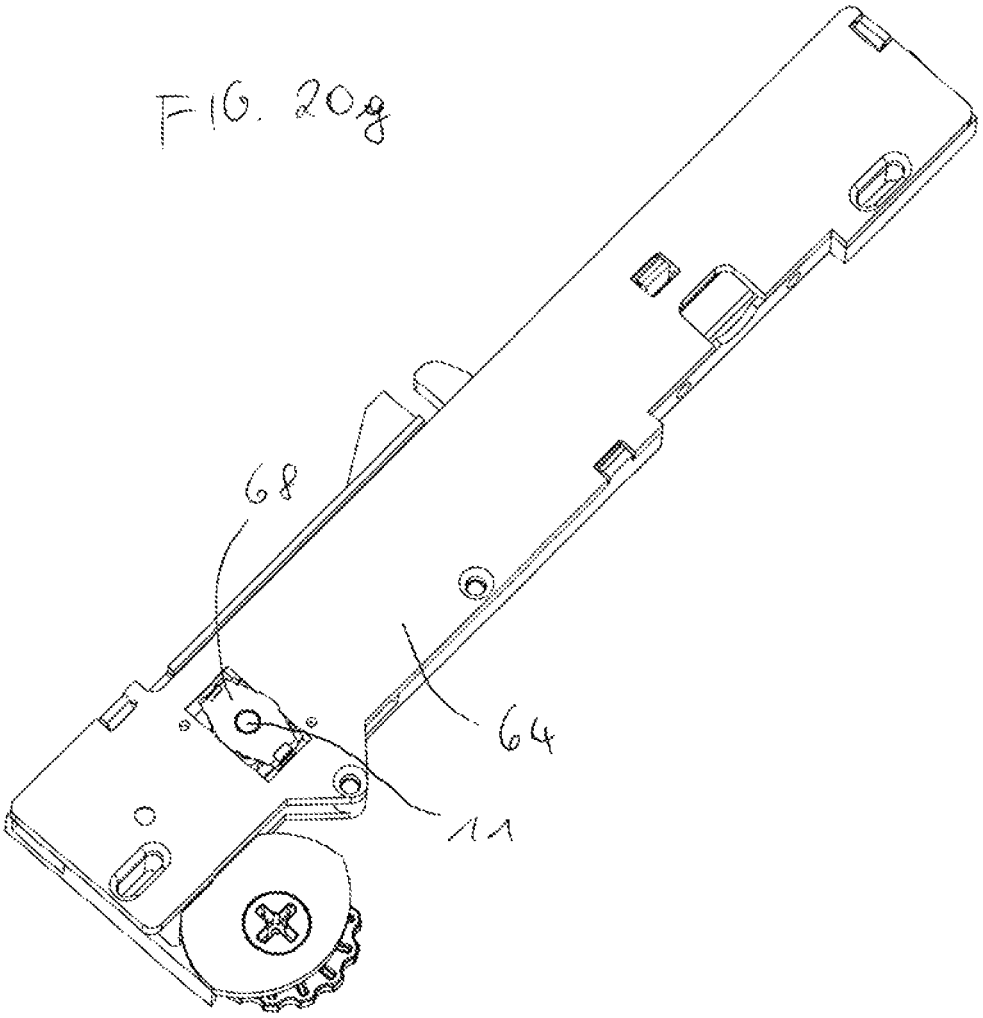
Figure 20H:
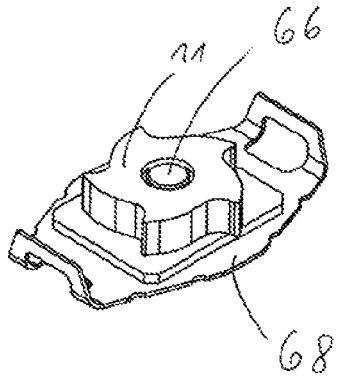
FIGS. 20*h*-20*k* show an embodiment of the damping device produced using multi-component injection molding.
Figure 20I:
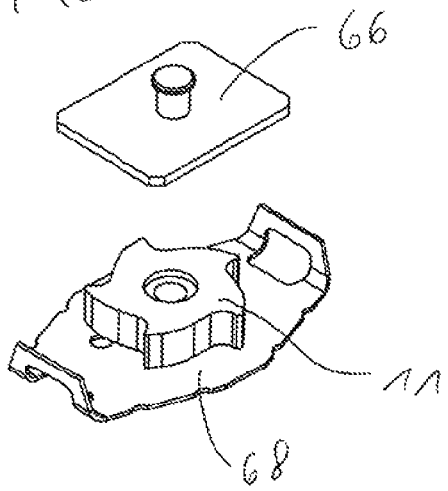
Figure 20J:
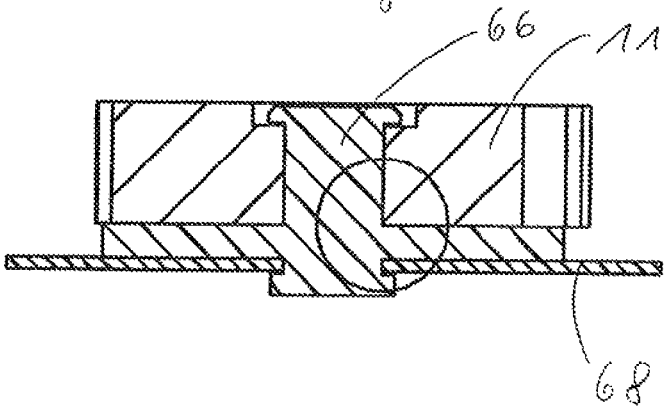
Figure 20K:
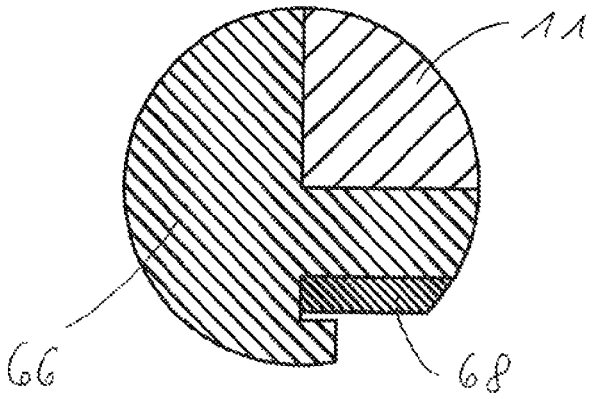

FIGS. 20*a* through 20*g* show a further embodiment of a damping device 8. In this variant it is possible to dispense with the use of a damping medium insofar as the damping action is produced by friction between two components which are preferably produced in a two-component injection molding. FIGS. 20*a* and 20*b* show the star-shaped gear 11 and the holding element 68 which jointly form the rotational damper 10. The holding element 68 made from steel has a bent-up extension portion 83 and an opening, wherein the extension portion 83 at the same time forms the gear rotary bearing 66. It will be seen from the sections in FIGS. 20*c* and 20*d* that the extension 83 projects into the gear 11 which comprises plastic. Shortly after the two-component injection molding operation the bent-up extension portion 83 and the gear contact each other substantially over the entire surface (see FIG. 20*e*). Due to the contraction or shrinkage 84 of the plastic material after the injection molding operation the connection between the bent-up extension portion 83 and the gear 11 is at least partially released (see FIG. 20*f*). That results in an undersize in relation to the sheet metal thickness. As a result the gear 11 can rotate relative to the holding element 68. The torque can be adjusted by adaptation of the wall thickness and the choice of material. FIG. 20*g* shows the damping device 8 in the installed condition on the base plate cover 64.

A possible design configuration for the damping device 8 in the form of a multi-component injection molding is shown in FIGS. 20*h* through 20*k*. In these views the gear rotary bearing 66 is not in the form of part of the holding element 68, but is "added by injection" as a separate plastic part to the holding element 68 and projects through an opening in the holding element 68. A further plastic part forming the gear 11 is also mounted rotatably to that plastic part forming the bearing 66. The damping action is produced by friction between the gear 11 and the bearing 66.

A damping medium is no longer necessary with those design configurations for the damping device 8, there are slight torque fluctuations, there is a low degree of temperature sensitivity and a longer service life is achieved.

Figure 21:
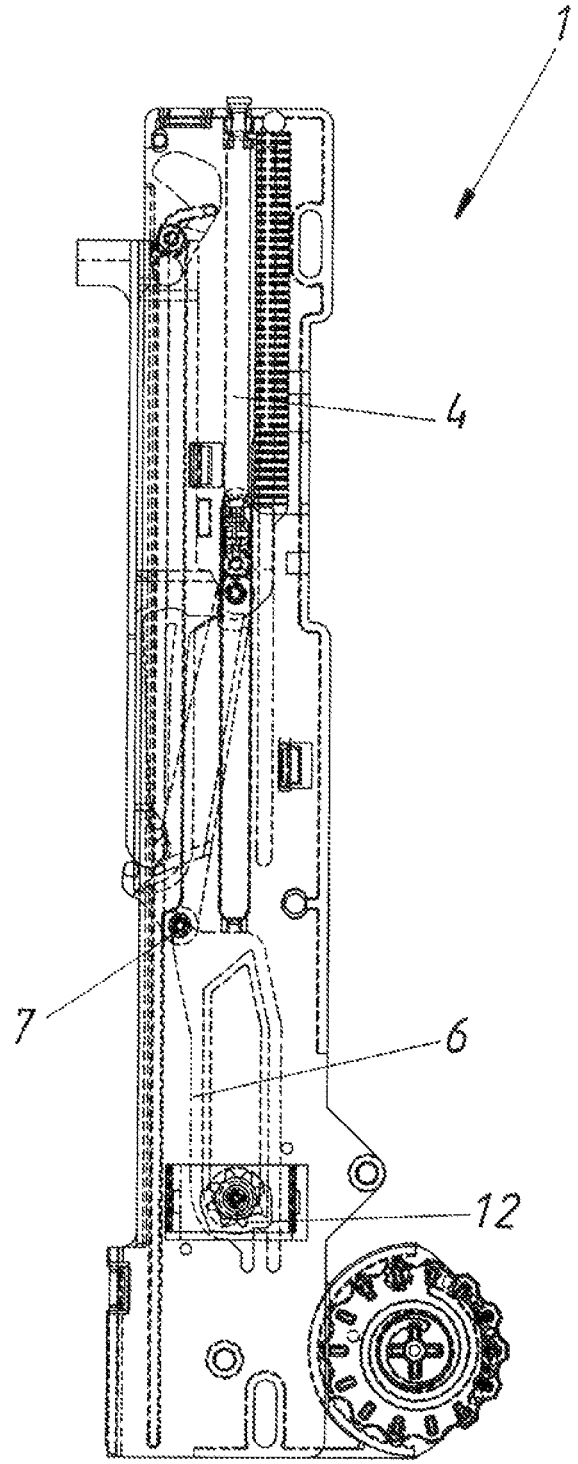
FIGS. 21 through 26 show a different position of the second drive device.

Referring to FIG. 21 the moveable furniture part 2 is in an open position OS, the locking pin 7 still being at the beginning of a stressing movement of the ejection force accumulator 4. It is also already apparent that a tooth 12 of the gear 11 projects into the latching engagement movement region E of the guide path 6.

Figure 22:
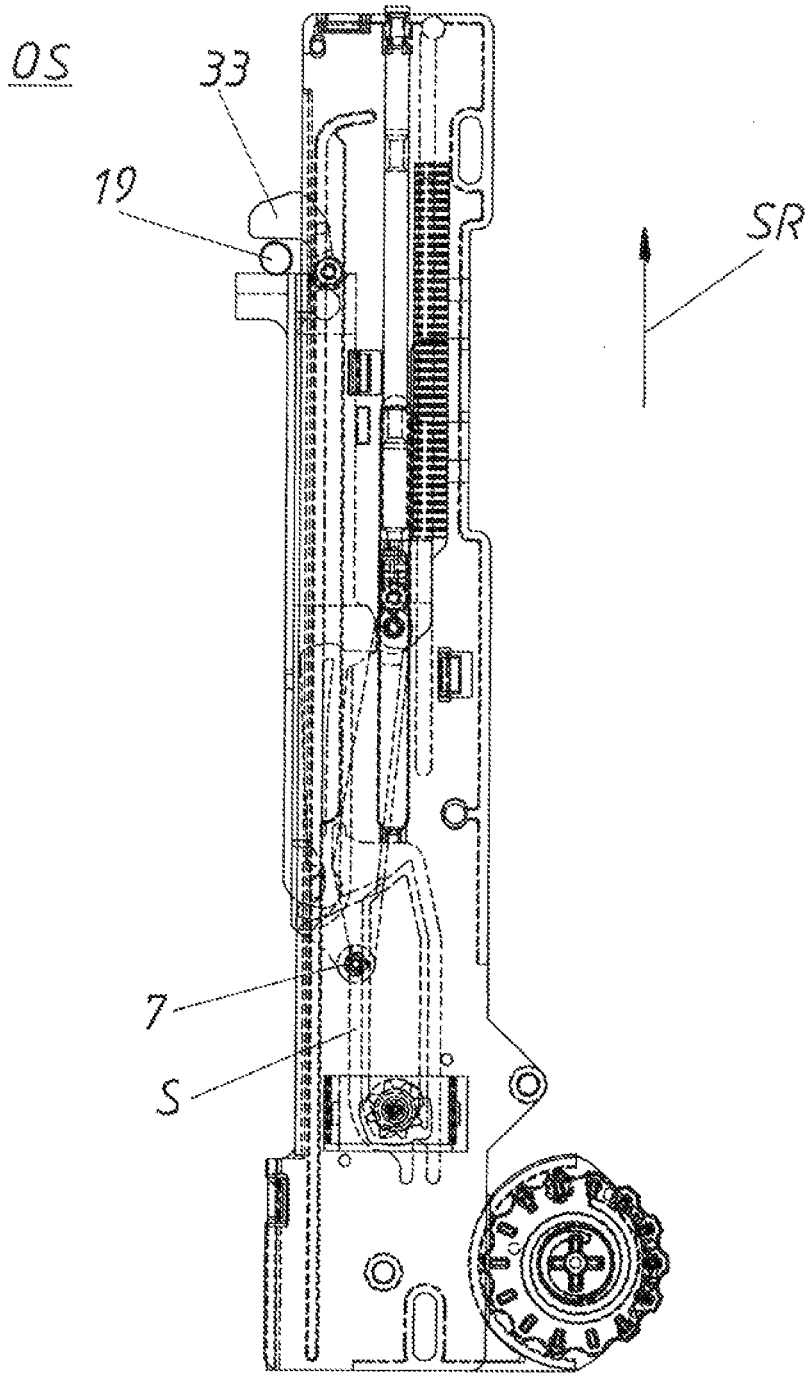

When now the moveable furniture part 2 is moved in the closing direction SR the entrainment portion 19 is caught in the catch region 34 of the coupling element 33. At the same time the locking pin 7 moves along the stressing portion S (see FIG. 22).

Figure 23:
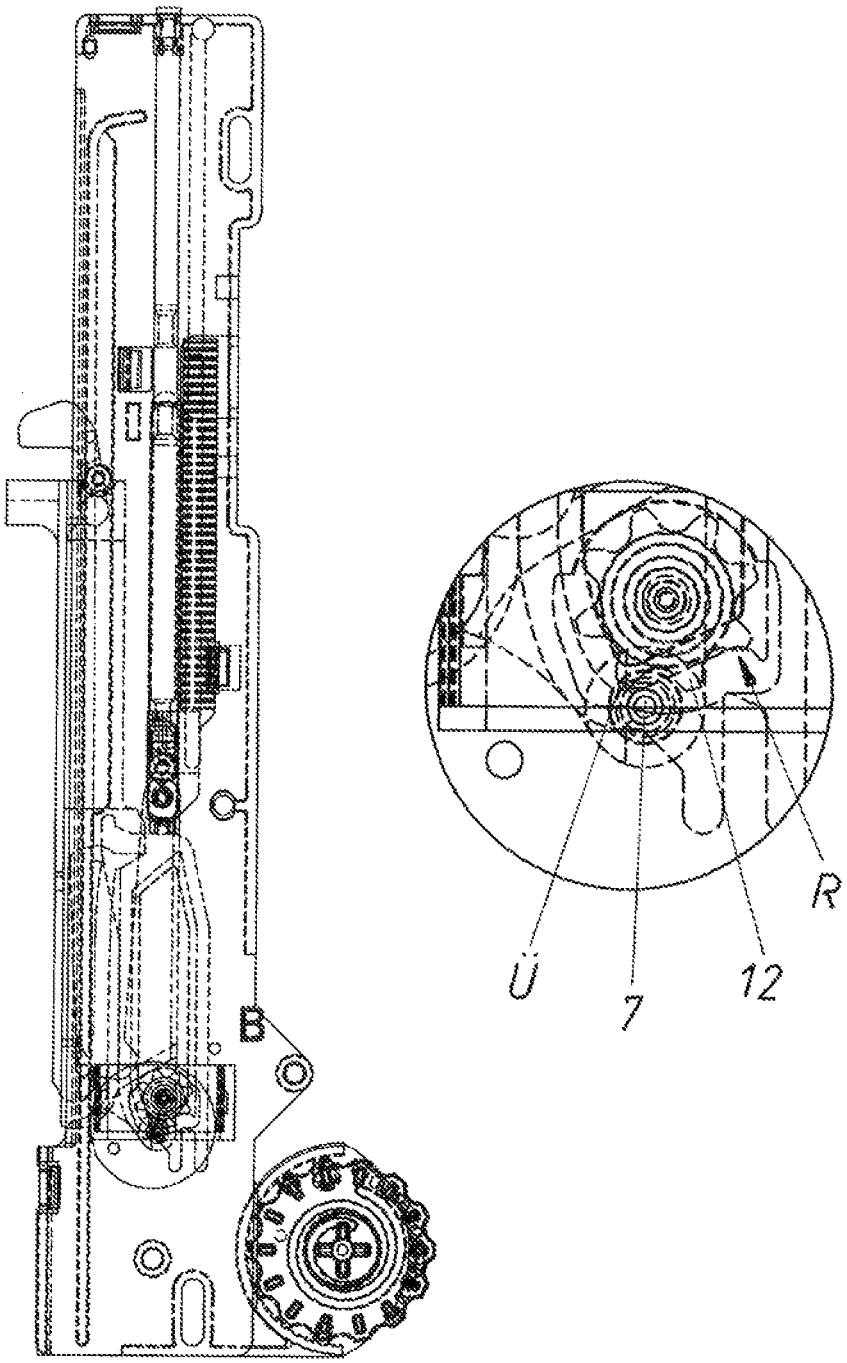

Referring to FIG. 23 the locking pin 7 has moved past the transitional region Ü and thereby passes into the latching engagement movement region E in which the full force of the ejection force accumulator 4 acts on the locking pin 7. That force, however, can act only until the locking pin 7 bears against the tooth 12 projecting into the latching engagement movement region E. More specifically, as soon as the locking pin 7 bears against that tooth 12 the movement of the locking pin 7 is braked by virtue of the damping action of the rotational damper 10 and the locking pin 7 moves only slowly in the direction of the latching region R.

Figure 24:
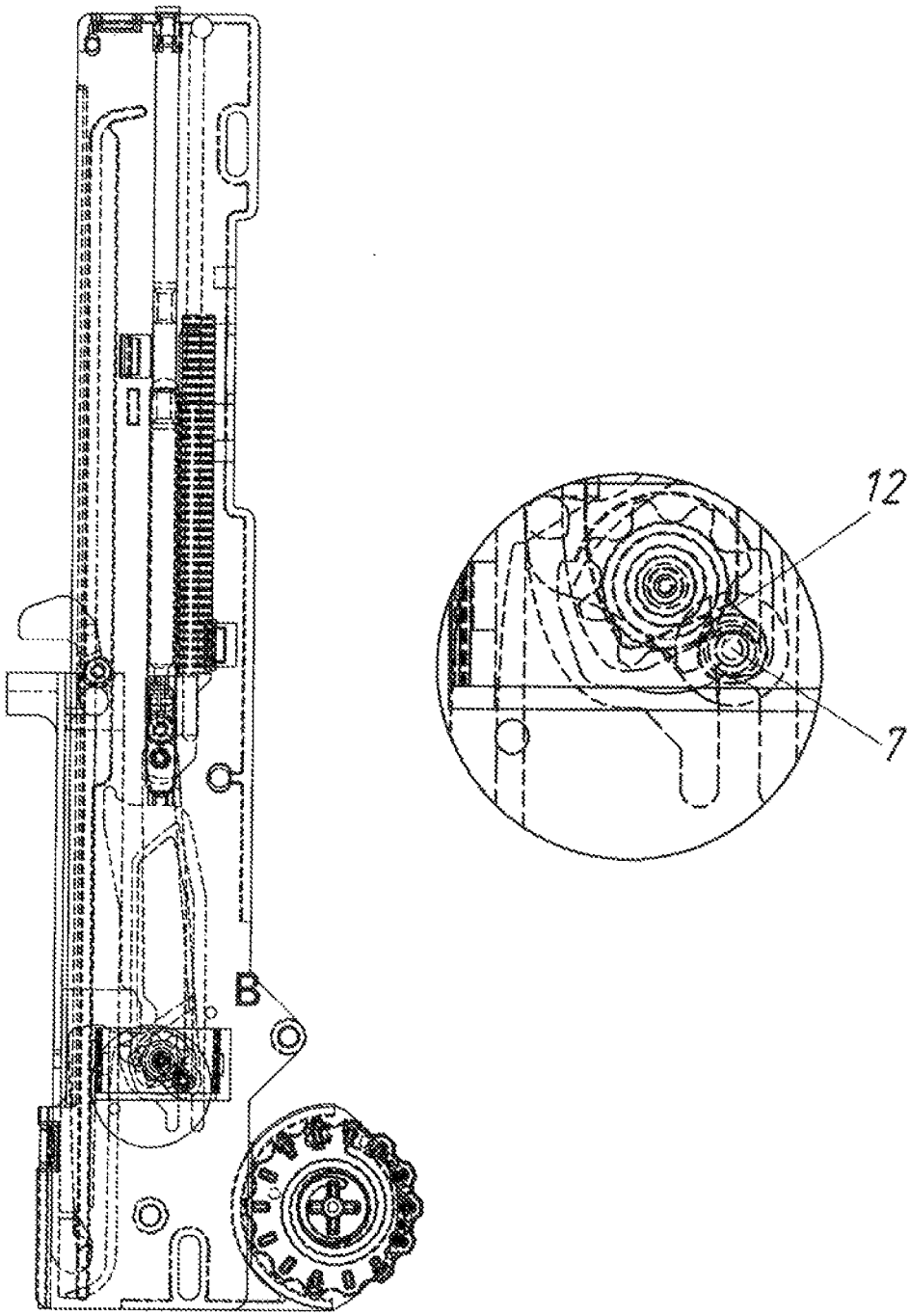

As soon as the gear 11 has moved in the counter-clockwise direction, with damping of the movement of the locking pin 7, until it no longer projects into the latching engagement movement region E, the locking pin 7 is in the latching region R of the guide path 6 as shown in FIG. 24. Thus the movement of the locking pin 7 is braked at least in a part of the latching engagement movement region E by the damping device 8 in the form of the rotational damper 10.

Figure 25:
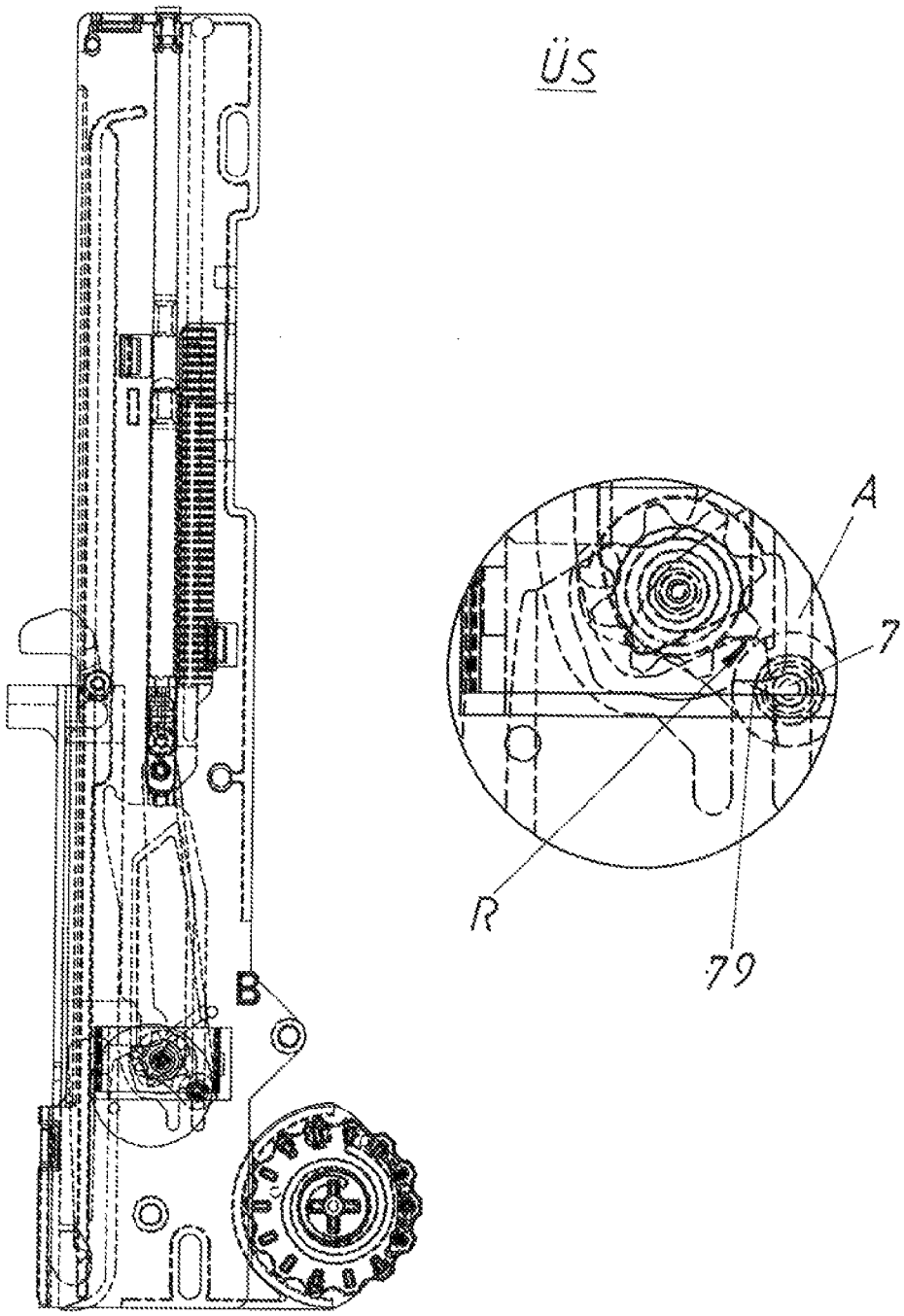

FIG. 25—as is known per se—shows the over-pressing position ÜS in which the locking pin 7 moves from the latching region R by way of the diversion surface 79 into the ejection portion A by over-pressing of the moveable furniture part 2 into an over-pressing position ÜS which is behind the closed position SS in the closing direction SR.

Figure 26:
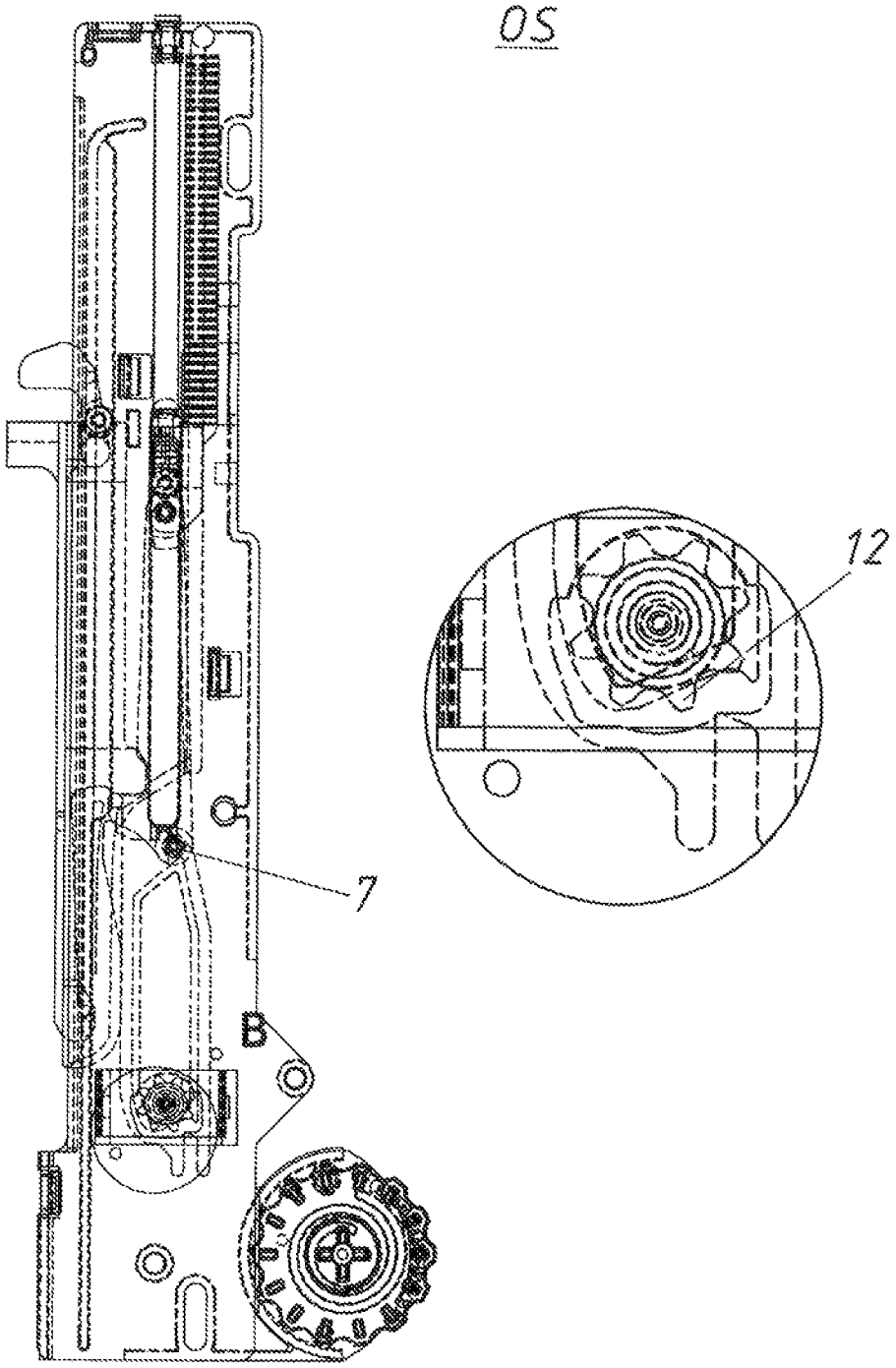

In FIG. 26, an open position OS is then again reached, in which the locking pin 7 passes into the region of the initial position again. A more detailed description of the remaining components and the remaining procedural movements of this embodiment as shown in FIGS. 19 through 26 will not be set forth here as the basic implementation substantially corresponds to the first embodiment and for that reason attention is correspondingly directed in substance thereto.

Figure 27:
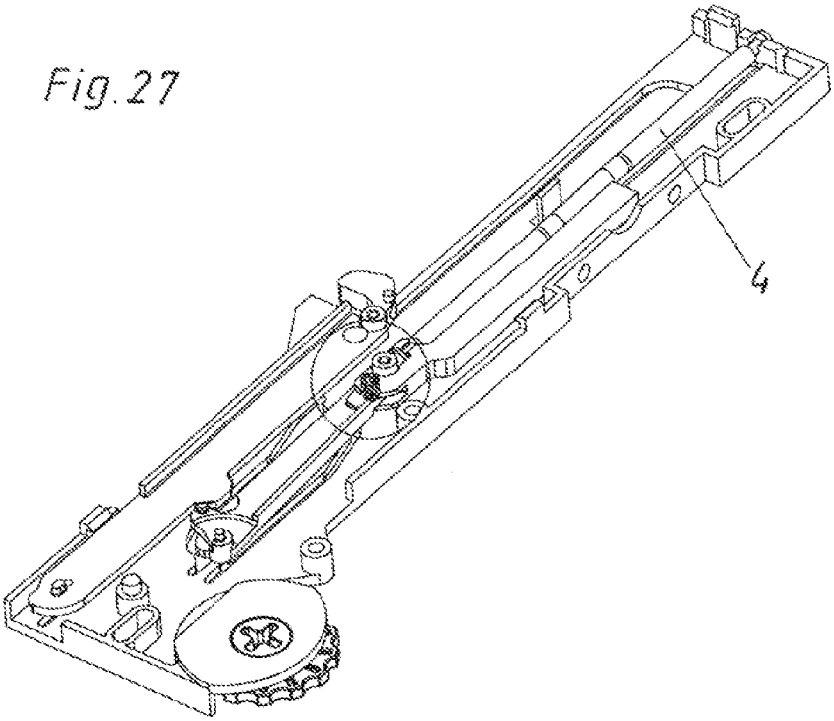
FIGS. 27 through 28 show a further embodiment of a damping device.
Figure 27:
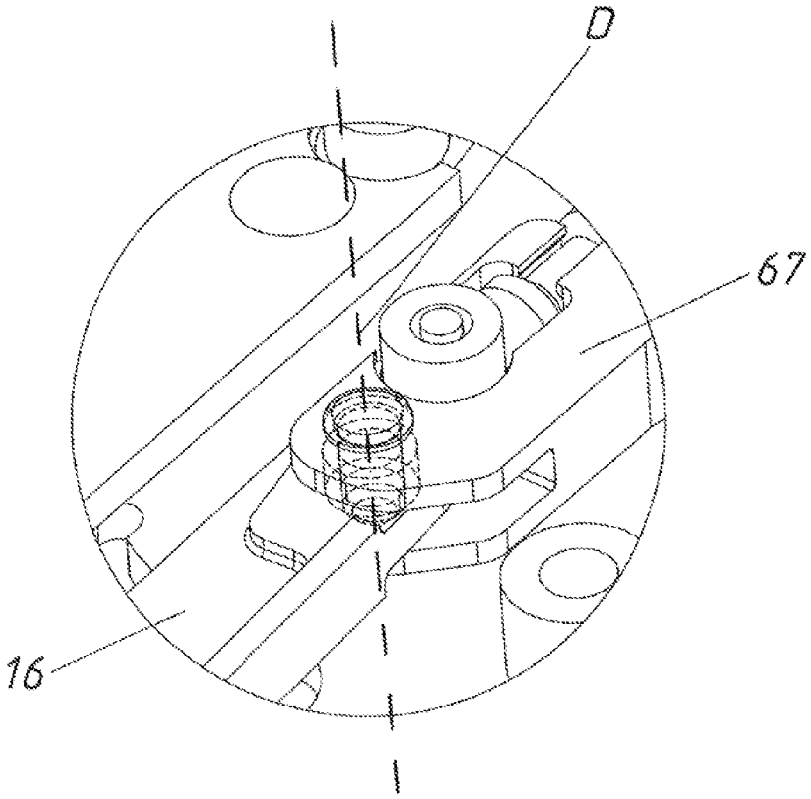
Figure 28:
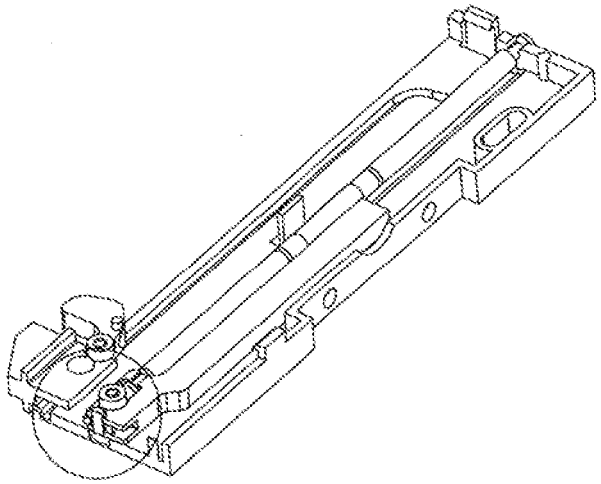
Figure 28:
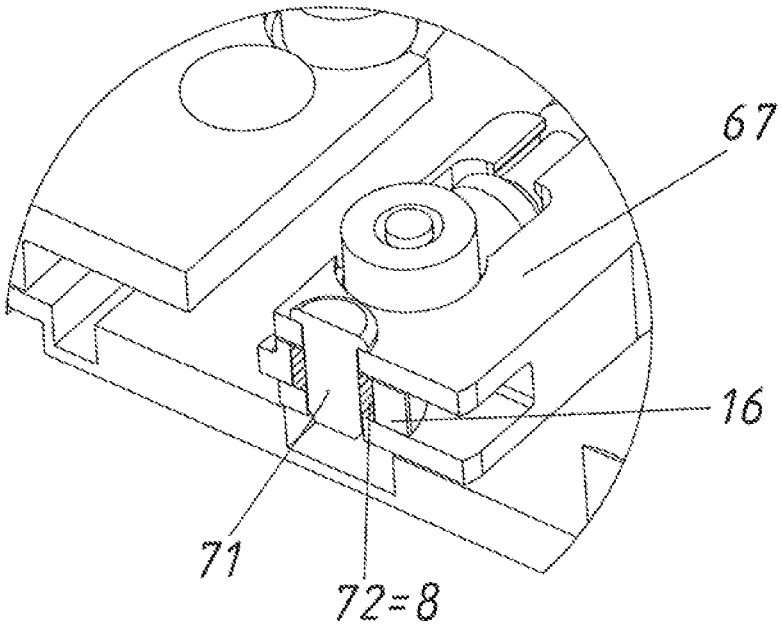

A further alternative embodiment of a possible way of placing the locking pin 7 in the latching region R in braked or damped relationship is shown in FIGS. 27 and 28. The basic structure in this embodiment also corresponds to the embodiment of FIGS. 19 through 26, it is only the damping device 8 that is of a different configuration. In this embodiment, there is no rotational damper 10 in the region of the latching engagement movement region E, but the pivotal movement of the locking lever 16 is damped by a damping device 8. For that purpose, the damping device 8 is disposed in the region of the axis of rotation D of the locking lever 16 on the synchronization element 67 or on the slider 15. More specifically, FIG. 28 shows a sectional view illustrating that a pin 71 forms the axis of rotation D for the locking lever 16. A friction brake 72 is arranged in an annular configuration between that pin 71 and the locking lever 16. The pivotal movement of the locking lever 16 can be damped by virtue of the fact that the friction brake 72 is very strongly clamped into the region between the locking lever 16 and the pin 71. As a result, the locking pin 7 is moved in a reduced-speed movement along the latching engagement movement region E. It will be appreciated that other kinds of shaft dampers are also conceivable.

Figure 29:
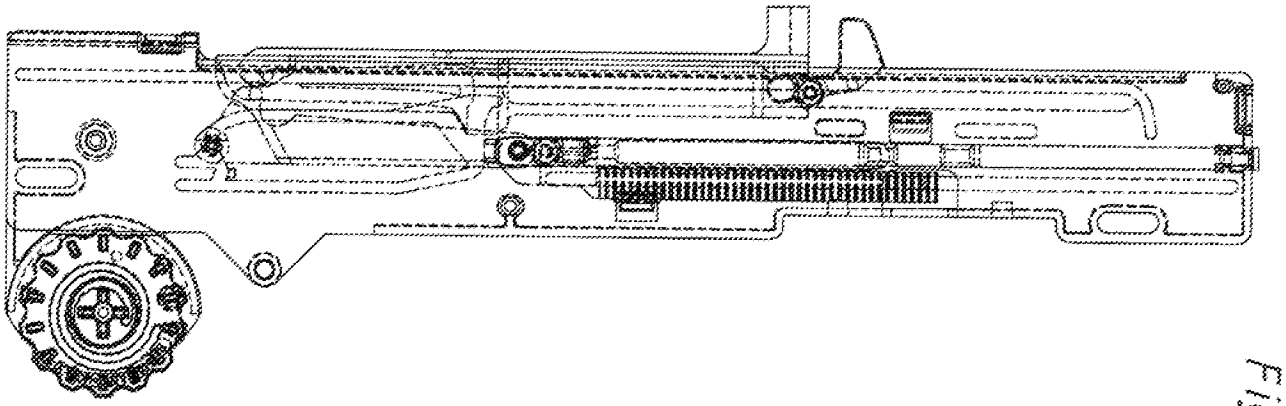
FIGS. 29 through 30 show a damping device in the form of a cushioned abutment, FIG. 31 diagrammatically shows the basic principle of the present invention.
Figure 29:
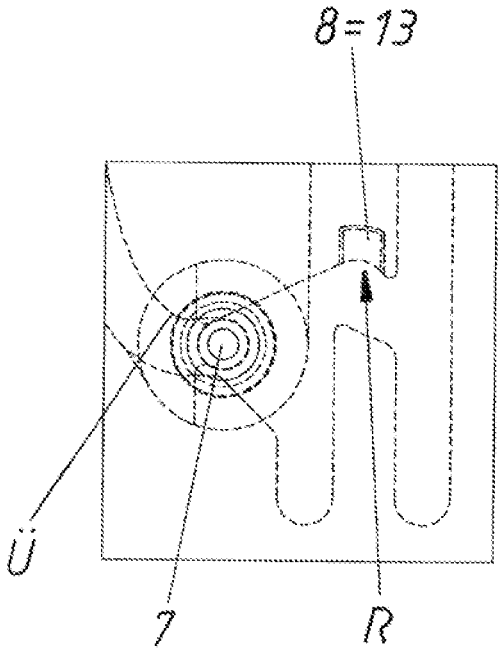
Figure 30:
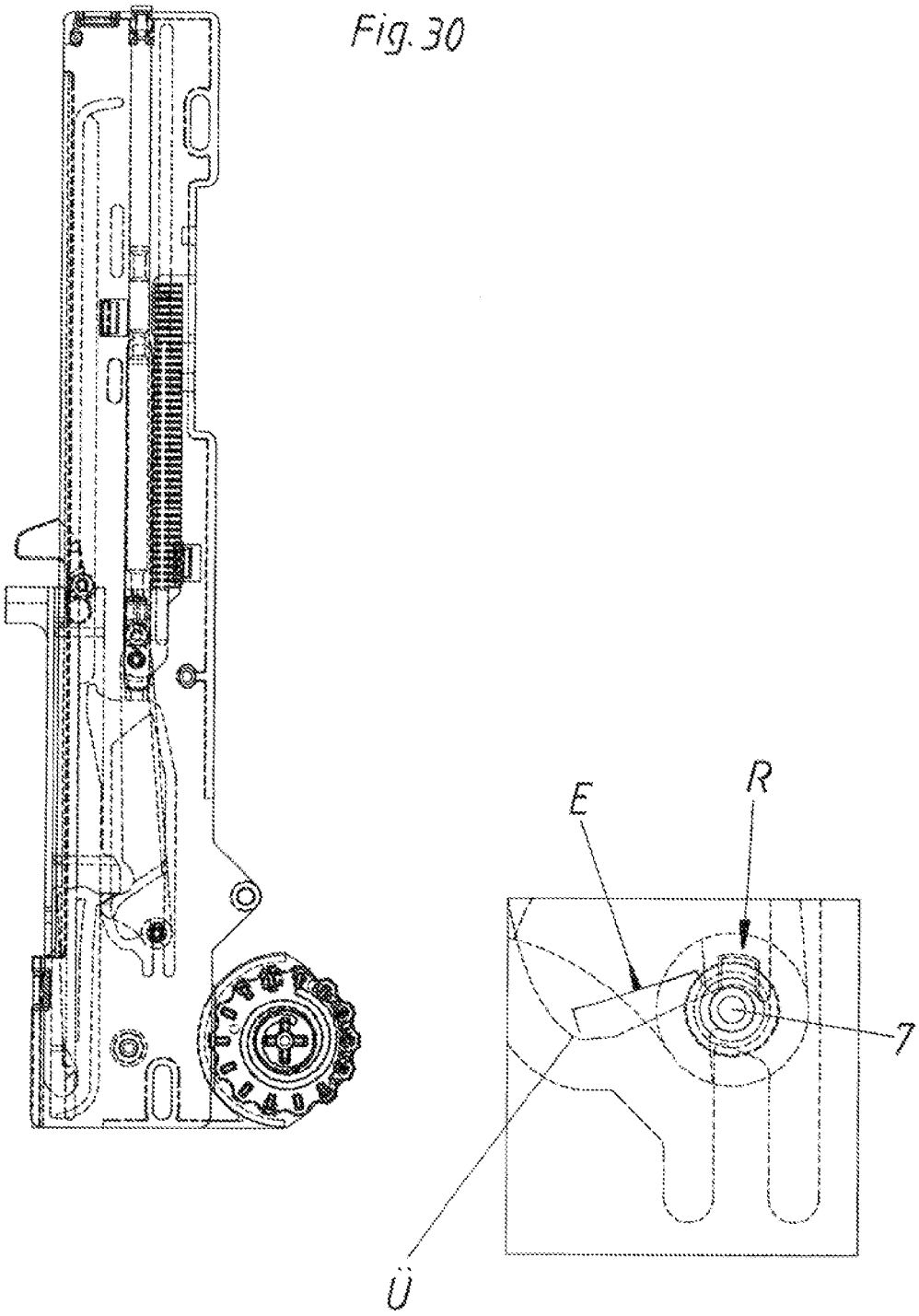

A further variant which is not according to the invention for moving the locking pin into the latching region R in braked or damped relationship is shown in FIGS. 29 and 30. In that case, the transmission of force from the ejection force accumulator 4 to the slider 15 is not damped and also the locking pin 7 is not braked in the latching engagement movement region E, but rather provided in the latching region R is a damping device 8 in the form of a cushioning 13 or an elastically yielding element. In that respect, it can be seen from FIG. 29 how the locking pin 7, after passing beyond the transitional region Ü, reaches the latching engagement movement region E. In that region E the locking pin 7 moves at full speed and under full load in the direction of the latching region R, where it arrives as shown in FIG. 30. To reduce the generation of noise the cushioning 13 is provided in the latching region R. Abutting contact is damped thereby.

Figure 31:
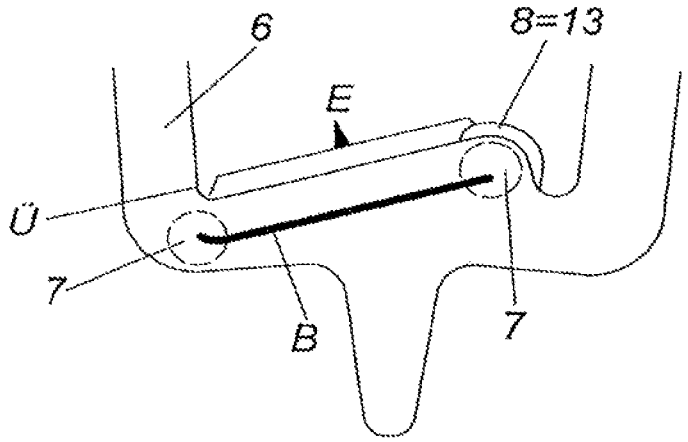

The fundamental concepts of the present invention are diagrammatically summarized once again in FIG. 31. It is essential that locking of the locking pin 7 in the latching region R of the guide path 6 is effected as quietly as possible.

For the purpose, in accordance with a first embodiment (FIGS. 3 through 18 and FIG. 32), there is provided a damped movement region B along the latching engagement movement region E. In this case, that can be effected by the fact that it is not the full force of the ejection force accumulator 4 that acts on the locking pin 7 or the guide path 6, for example by way of a travel transmission mechanism or a linear damper, along that latching engagement movement region E.

In a further embodiment (FIGS. 19*a* through 28) the movement of the locking pin 7 in that movement region B can be braked at least portion-wise by a damping device 8 for example in the form of a rotational damper or a pivotal movement damper.

As a third variant which is not according to the invention (see also FIGS. 29 and 30) abutment in the latching region R can be damped in itself. For that purpose, the damping device 8 can be in the form of a cushioning 13 or an elastic element fitted to the wall of the guide path 6.

Figure 34:
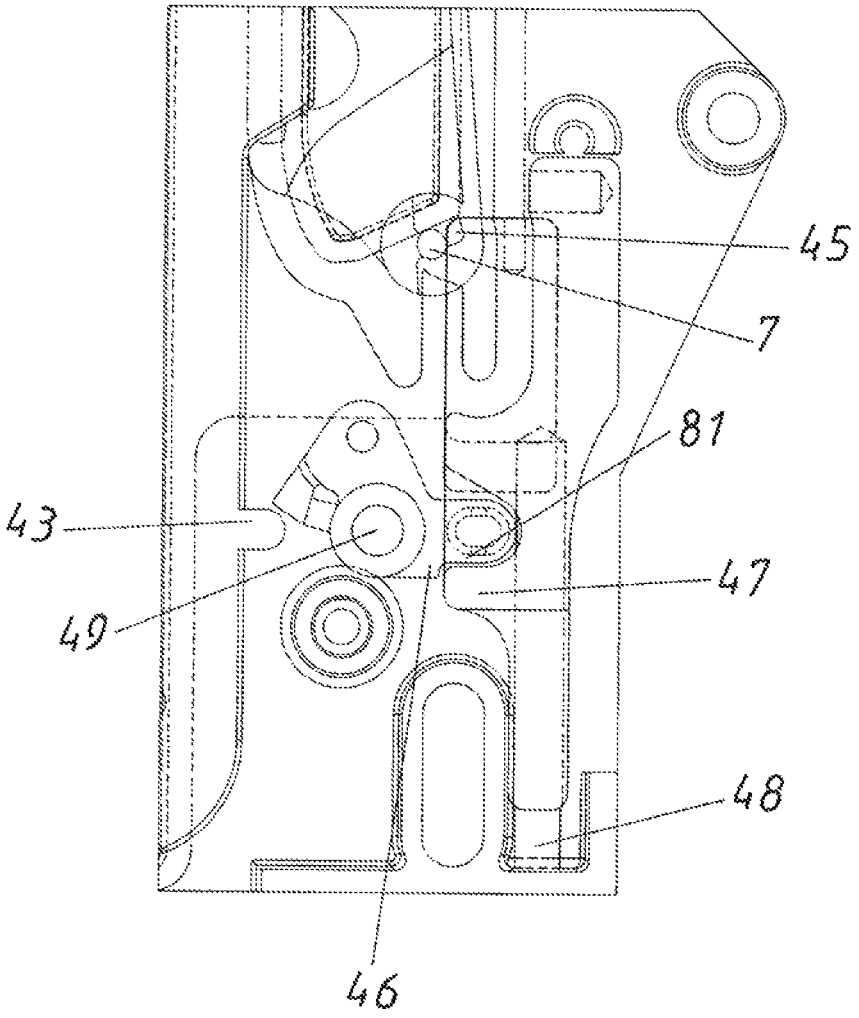
Figure 35:
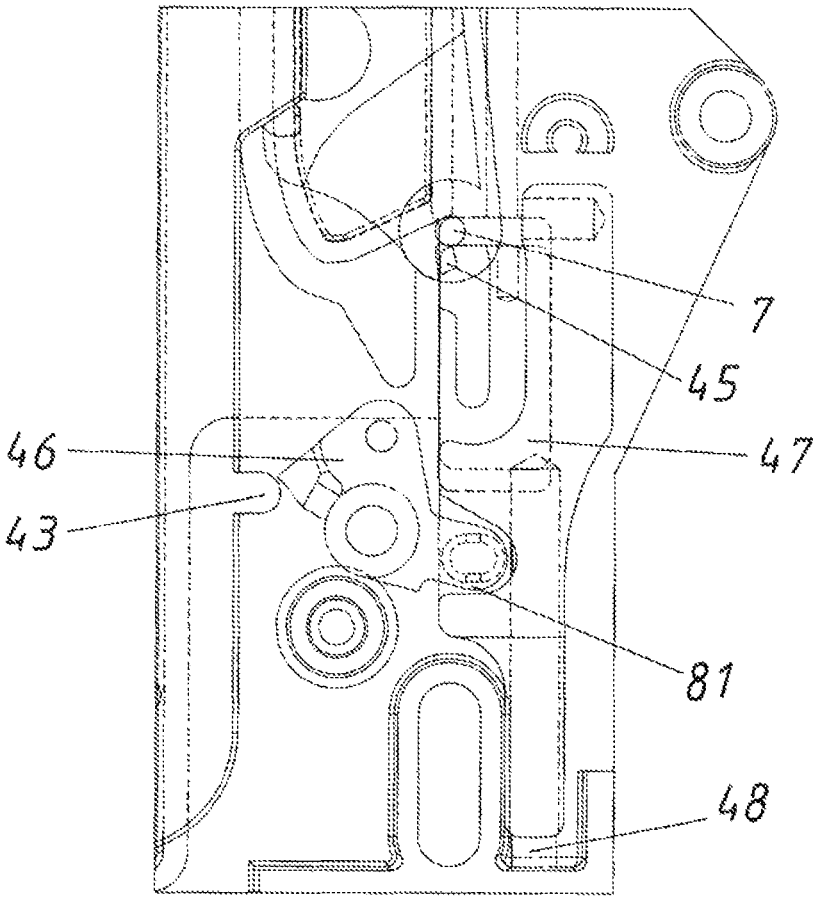
Figure 36:
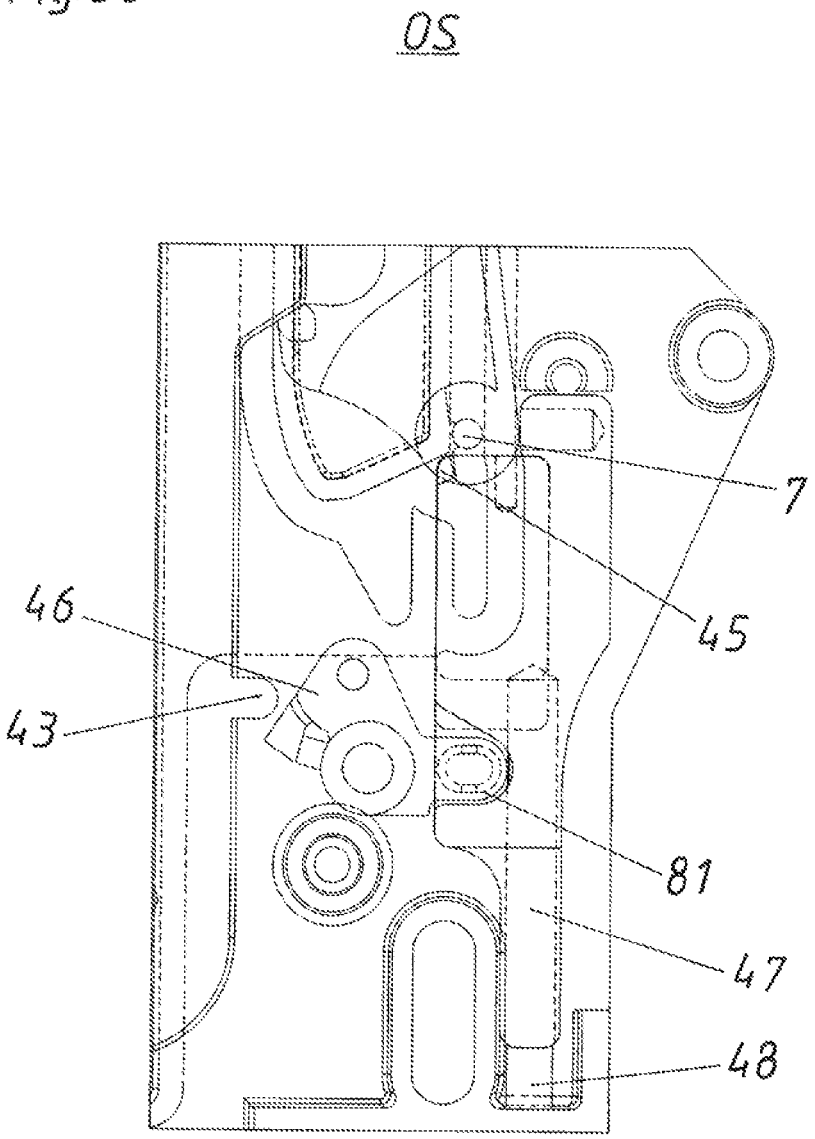
Figure 37:
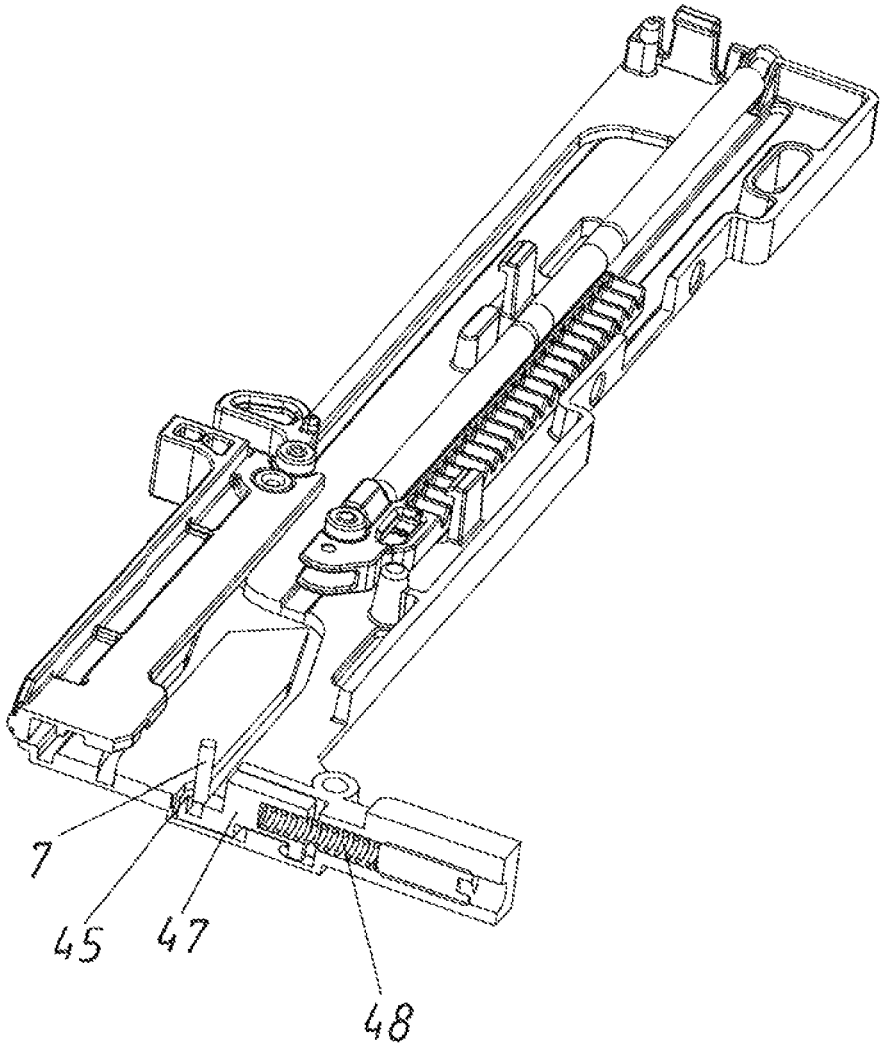

FIG. 13 shows an embodiment for unlocking and ejection by pulling. A further variant for unlocking by pulling is shown in FIGS. 33 through 36, whereby the drive device 1 has a pulling triggering element 46 rotatable about the rotary bearing 49. That triggering element 46 engages by an arm 81 into an opening in the pulling triggering element 47. The locking abutment 45 is provided on that pulling triggering element 47. When, starting from the closed position SS as shown in FIG. 34 a pulling force is applied to the moveable furniture part 2 in the opening direction OR the pulling triggering element 46 is rotated by the abutment 43 in the clockwise direction about the bearing 49 so that, by way of the arm 81, the pulling triggering element 47 is moved against the force of the spring 48 (see FIG. 35). As a result, the locking abutment 45 is also moved and enables a passage for the locking pin 7. In that way, the ejection force accumulator 4 can be relieved of stress and the moveable furniture part 2 is moved into an open position OS, in which case the locking pin 7 passes into the position shown in FIG. 36.

Figure 38:
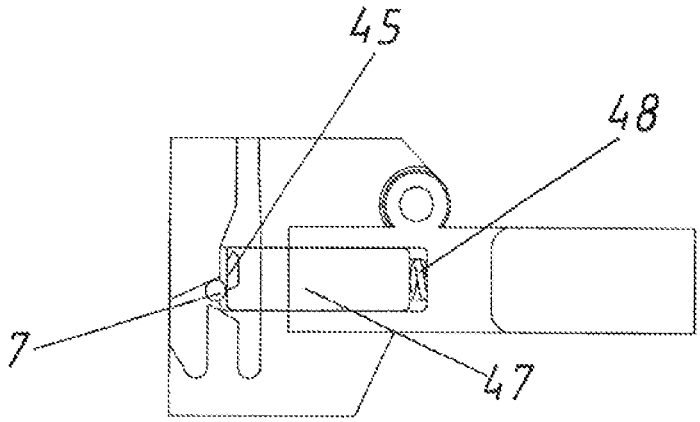
Figure 39:
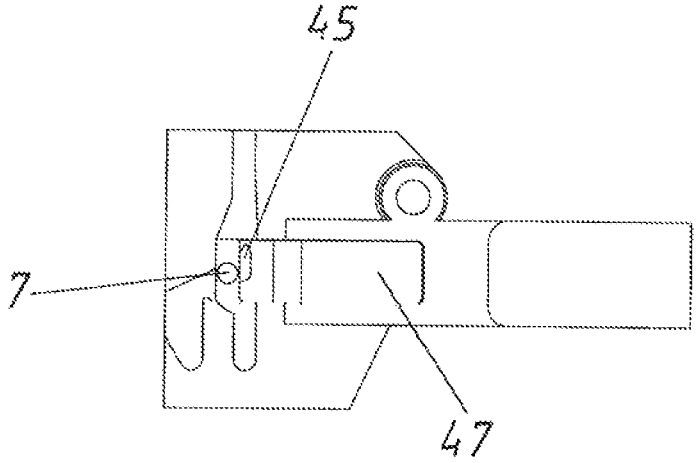
Figure 40:
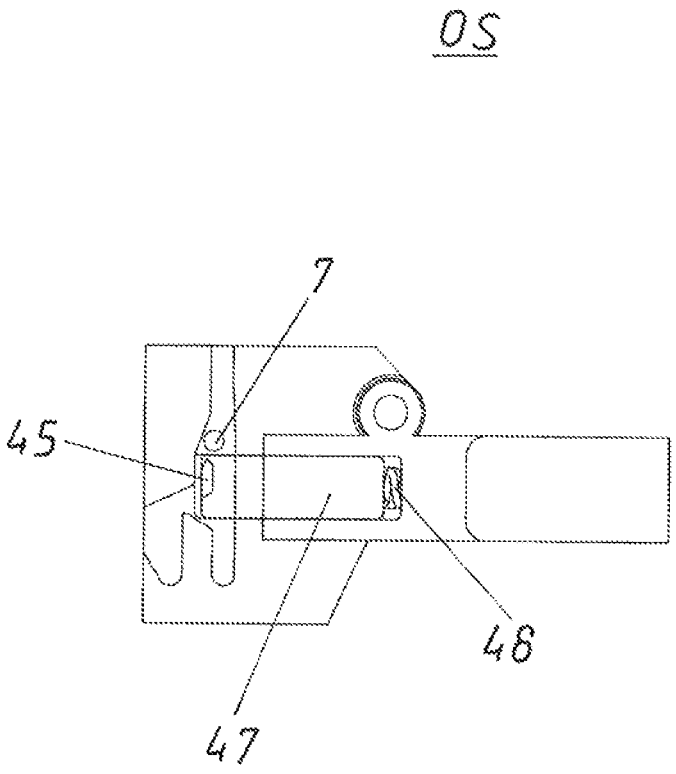

A further pulling triggering variant is shown in FIGS. 37 through 40 wherein the locking abutment 45 is provided on a pulling triggering element 47 moveable transversely relative to the closing direction SR. When, starting from the closed position SS as shown in FIG. 38 a pulling force is applied to the moveable furniture part 2 in the opening direction OR, then the locking pin 7 itself moves the pulling triggering element 47 together with the locking abutment 45 against the force of the spring 48 into the position according to 39. This means that the locking pin 7 is no longer locked and a passage for the locking pin 7 is enabled or opened. The ejection force accumulator 4 can then be relieved of stress and ejects the moveable furniture part 2 in the opening direction OR into an open position OS whereby the locking pin 7 passes into the position shown in FIG. 40.

The invention claimed is:

1. A drive device for moving a moveable furniture part, said drive device comprising:

an ejection element;

an ejection force accumulator;

a locking device for locking said ejection element, said locking device including a locking pin to be acted upon by said ejection force accumulator; and a cardioid-shaped guide path having a stressing region, a latching engagement movement region, and a latching region;

wherein ejection element, said ejection force accumulator, and said locking device are configured and arranged such that:

said locking pin is lockable in a locking position in said latching region of said guide path;

said locking pin is moveable within said stressing region of said guide path upon stressing of said ejection force accumulator;

said locking pin acted upon by said ejection force accumulator is moveably braked or damped while moving in said latching engagement movement region before reaching said latching region; and said locking pin is breakable or dampable in said latching region.

2. The drive device as set forth in claim 1, wherein said latching region of said guide path is spaced apart in the opening direction of the moveable furniture part from a transitional region of said guide path, said transitional region being located between the stressing region and said latching engagement movement region.

3. The drive device as set forth in claim 1, wherein said latching region is spaced apart in the opening direction of the moveable furniture part from said transitional region by between 0.2 mm and 3.0 mm.

4. The drive device as set forth in claim 2, wherein said locking pin is configured to be completely uncoupled from a movement of the moveable furniture part as from attainment of said transitional region so that said locking pin is moveable into said latching region along said latching engagement movement region by said ejection force accumulator.

5. The drive device as set forth in claim 1, further comprising a damping device operative between said ejection force accumulator and said locking pin, said damping device being configured to damp kinetic energy transmitted from said ejection force accumulator to said locking pin before said locking position is reached.

6. The drive device as set forth in claim 5, wherein the kinetic energy acting on said locking pin is reduced by said damping device only in said latching engagement movement region of said locking pin.

7. The drive device as set forth in claim 5, wherein said damping device is a travel transmission mechanism.

8. The drive device as set forth in claim 7, wherein said locking pin is configured to be placed in the latching region in a cam-controlled relationship by said travel transmission mechanism.

9. The drive device as set forth in claim 8, wherein said travel transmission mechanism includes a control cam configured to steadily increase the kinetic energy acting from said ejection force accumulator on said locking pin along said latching engagement movement region based on said control cam.

10. The drive device as set forth in claim 5, wherein said damping device has a moveable damping element.

11. The drive device as set forth in claim 10, wherein said moveable damping element is a rotational damper.

12. The drive device as set forth in claim 10, wherein said damping element includes a gear mounted in damped rotary relationship, at least one tooth of said gear is configured to be contacted by said locking pin in said latching engagement movement region and is moveable in damped relationship in a direction of said latching region.

13. The drive device as set forth in claim 1, further comprising a base plate, said ejection element comprising a slider moveable relative to said base plate and lockable to said base plate by said locking device.

14. The drive device as set forth in claim 13, wherein said ejection force accumulator is fixed to said base plate and to said slider.

15. The drive device as set forth in claim 14, wherein said ejection force accumulator is a tension spring.

16. The drive device as set forth in claim 13, wherein said locking pin is mounted rotatably to said slider by a locking lever so as to engage into said guide path in said base plate.

17. The drive device as set forth in claim 1, wherein said ejection force accumulator is loadable by at least one of opening and closing the moveable furniture part.

18. An article of furniture comprising:

a furniture carcass;

a moveable furniture part moveable relative to said furniture carcass; and said drive device as set forth in claim 1 for moving said moveable furniture part.

19. The article of furniture as set forth in claim 18, wherein said drive device includes:

a base plate arranged on said moveable furniture part; and an entrainment portion to be brought into engagement with said ejection element of said drive device, said entrainment portion being arranged on said furniture carcass.

* * * * *